US008022024B2

(12) United States Patent
Swartele et al.

(10) Patent No.: US 8,022,024 B2
(45) **Date of Patent: *Sep. 20, 2011**

(54) FUNCTIONAL FLUID COMPOSITIONS

(75) Inventors: Chantal R. Swartele, Laame (BE); John M. Rosenbaum, Richmond, CA (US); Marc J. De Weerdt, Machelen (BE); Thomas Plaetinck, Zomergem (BE); Stephen J. Miller, San Francisco, CA (US); Mark L. Sztenderowicz, San Francisco, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 341 days.

This patent is subject to a terminal disclaimer.

(21) Appl. No.: 11/770,489

(22) Filed: Jun. 28, 2007

(65) Prior Publication Data

US 2009/0005273 A1 Jan. 1, 2009

(51) Int. Cl.
*C10M 145/14* (2006.01)

(52) U.S. Cl. ..... 508/469; 508/110

(58) Field of Classification Search ..... 508/110, 508/469; 208/18, 19; 585/1
See application file for complete search history.

(56) References Cited

U.S. PATENT DOCUMENTS

| | | | | |
|---|---|---|---|---|
| 6,562,230 | B1 * | 5/2003 | O'Rear et al. | 208/66 |
| 6,806,237 | B2 * | 10/2004 | O'Rear | 508/110 |
| 7,078,391 | B2 | 7/2006 | Peterson et al. | |
| 2004/0154958 | A1 | 8/2004 | Alexander et al. | |
| 2005/0043192 | A1 * | 2/2005 | Alexander | 508/469 |
| 2005/0077208 | A1 * | 4/2005 | Miller et al. | 208/18 |
| 2005/0241990 | A1 | 11/2005 | Ziemer et al. | |
| 2005/0247600 | A1 | 11/2005 | Miller et al. | |
| 2005/0261147 | A1 * | 11/2005 | Rosenbaum et al. | 508/466 |
| 2006/0131210 | A1 | 6/2006 | Rosenbaum et al. | |
| 2006/0199744 | A1 | 9/2006 | Walton et al. | |
| 2006/0199896 | A1 | 9/2006 | Walton et al. | |
| 2006/0201851 | A1 | 9/2006 | Rosenbaum et al. | |
| 2007/0259792 | A1 * | 11/2007 | Null | 508/583 |

FOREIGN PATENT DOCUMENTS

| | | | |
|---|---|---|---|
| EP | 945641 | A2 * | 9/1999 |
| EP | 0992570 | A2 | 4/2000 |
| EP | 992570 | A2 * | 4/2000 |
| EP | 1845151 | A | 10/2007 |
| JP | 2000-109877 | | 4/2000 |
| JP | 2000109877 | A | 4/2000 |
| JP | 2004182931 | A | 7/2004 |
| JP | 2005154760 | A | 6/2005 |
| KR | 20060013927 | A | 2/2006 |
| WO | WO 2007/107506 | A1 | 9/2007 |
| WO | WO2007107506 | A | 9/2007 |

OTHER PUBLICATIONS

PCT Written Opinion of the International Searcing Authority, dated May 11, 2009, 19 pages.

* cited by examiner

*Primary Examiner* — James Goloboy
*Assistant Examiner* — Pamela H Weiss
(74) *Attorney, Agent, or Firm* — Susan M. Abernathy

(57) ABSTRACT

A functional fluid comprising a base oil with a high viscosity index, wherein the functional fluid has a kinematic viscosity at 100° C. between 2.5 and 5.0 $mm^2/s$, a low Brookfield viscosity, a high aniline point, and excellent air release. Shock absorber fluids with improved performance, comprising a particular base oil, wherein the improved performance includes high viscosity index, low Brookfield viscosity, high aniline point, excellent air release and high flash point.

28 Claims, 3 Drawing Sheets

FUNCTIONAL FLUID COMPOSITIONS

RELATED APPLICATIONS

This application is related to two other applications filed concurrently with this application. Those applications are "Process for Making Shock Absorber Fluid" (by Mark Sztenderowivcz, John Rosenbaum, Marc De Weerdt, Thomas Plaetinck, Chantal Swartele, and Stephen Miller) and "Power Steering Fluid" (by John Rosenbaum, Marc De Weerdt, and Kurt Schuermans).

FIELD OF THE INVENTION

This invention is directed to functional fluid compositions, and more specifically to shock absorber fluid compositions, having improved performance properties.

BACKGROUND OF THE INVENTION

Functional fluids are lubricants used in enclosed systems to transmit power. Examples of systems where functional fluids are used include shock absorbers, hydraulic systems, power steering systems, and transmissions. Shock absorber fluids are low viscosity oils that must operate at a wide temperature range, especially high temperature. Current oils often fail due to high temperature and may even get so hot that they melt the paint on the shock absorbers. Current shock absorber fluids are made using a petroleum derived base oil that is a pale oil spindle oil, and the shock absorber fluids have a viscosity index of less than 130, a Brookfield viscosity at −30° C. of 1000 mPa·s, an air release after 1 minute by DIN 51831 of greater than 1.0 vol %, and an aniline point less than 95° C.

Improvements in functional fluids, and specifically shock absorber fluids are needed, without having to use highly expensive synthetic base oils.

SUMMARY OF THE INVENTION

The present invention provides a shock absorber fluid, comprising less than 4.0 wt % combined viscosity index improver and pour point depressant, based on the total shock absorber fluid; wherein the shock absorber fluid has a kinematic viscosity at 100° C. less than 5 $mm^2/s$, a viscosity index greater than or equal to 129, and a Brookfield viscosity at −30° C. less than 1,000 mPa·s.

In another embodiment the present invention provides a shock absorber fluid, comprising a base oil having a base oil kinematic viscosity at 100° C. less than 3.0 $mm^2/s$, consecutive numbers of carbon atoms, less than 10 wt % napththenic carbon, and a viscosity index greater than 121; wherein the shock absorber fluid has a kinematic viscosity at 100° C. less than 5 $mm^2/s$ and an aniline point greater than or equal to 95° C.

In another embodiment the present invention provides a shock absorber fluid, comprising a base oil having a base oil kinematic viscosity at 100° C. less than 3.0 $mm^2/s$, consecutive numbers of carbon atoms, less than 10 wt % naphthenic carbon, and a viscosity index greater than 121; wherein the shock absorber fluid has an air release after 1 minute by DIN 51381 of less than 0.8 vol %.

In another embodiment the present invention provides a shock absorber fluid, comprising:

a. a base, oil, having consecutive numbers of carbon atoms, a kinematic viscosity at 100° C. between 1.5 and 3.5 $mm^2/s$, and less than 10 wt % naphthenic carbon; and b. less than 4.0 wt % combined viscosity index improver and pour point depressant, based on the total shock absorber fluid;

wherein the shock absorber fluid has an air release after 1 minute by DIN 51381 of less than 0.8 vol %.

In another embodiment the present invention provides a functional fluid having a flash point greater than 195° C. and a kinematic viscosity at 100° C. less than 5 $mm^2/s$, comprising: greater than 95 wt % based on the total functional fluid composition of a base oil having: consecutive numbers of carbon atoms, and between 2 wt % and less than 5 wt % naphthenic carbon; and wherein the base oil is an XLN grade, an XXLN grade, or a blend of XLN grade and XXLN grade.

Additionally, the present invention provides a functional fluid, comprising a base oil having a base oil kinematic viscosity of at least 1.5 $mm^2/s$ and a viscosity index greater than an amount calculated by the equation: 22×Ln (Kinematic Viscosity at 100° C.)+132; wherein the functional fluid has a kinematic viscosity at 100° C. between 2.5 and 5.0 $mm^2/s$, a Brookfield viscosity at −30° C. less than 1,000 mPa·s, an aniline point greater than or equal to 95° C., and an air release after 1 minute by DIN 51381 of less than 0.8 vol %.

BRIEF DESCRIPTION OF THE DRAWINGS

FIG. 1 illustrates the plot of Kinematic Viscosity at 100° C. in $mm^2/s$ vs. viscosity index, providing the equations for calculation of the lower limits for viscosity index of:

$$28\times\text{Ln(Kinematic Viscosity at 100° C.)}+80,$$

$$28\times\text{Ln(Kinematic Viscosity at 100° C.)}+90, \text{ and}$$

$$28\times\text{Ln(Kinematic Viscosity at 100° C.)}+95,$$

wherein Ln(Kinematic Viscosity at 100° C.) is the natural logarithm with base "e" of Kinematic Viscosity at 100° C. in $mm^2/s$.

Figure 2:
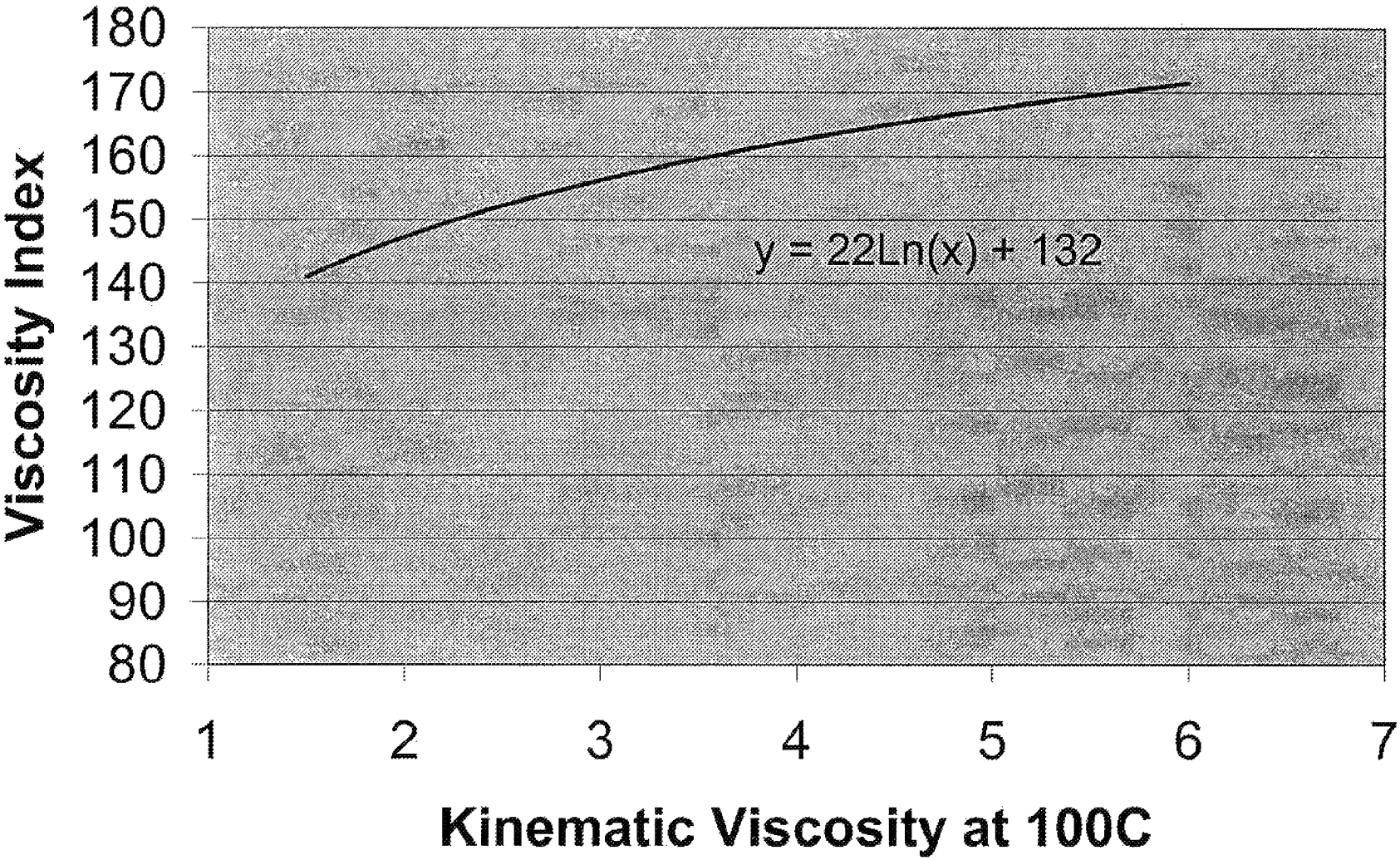

FIG. 2 illustrates the plot of Kinematic Viscosity at 100° C. in $mm^2/s$ vs. viscosity index, providing the equations for calculation of the lower limits for viscosity index of:

$$22\times\text{Ln(Kinematic Viscosity at 100° C.)}+132,$$

wherein Ln(Kinematic Viscosity at 100° C.) is the natural logarithm with base "e" of Kinematic Viscosity at 100° C. in $mm^2/s$.

Figure 3:
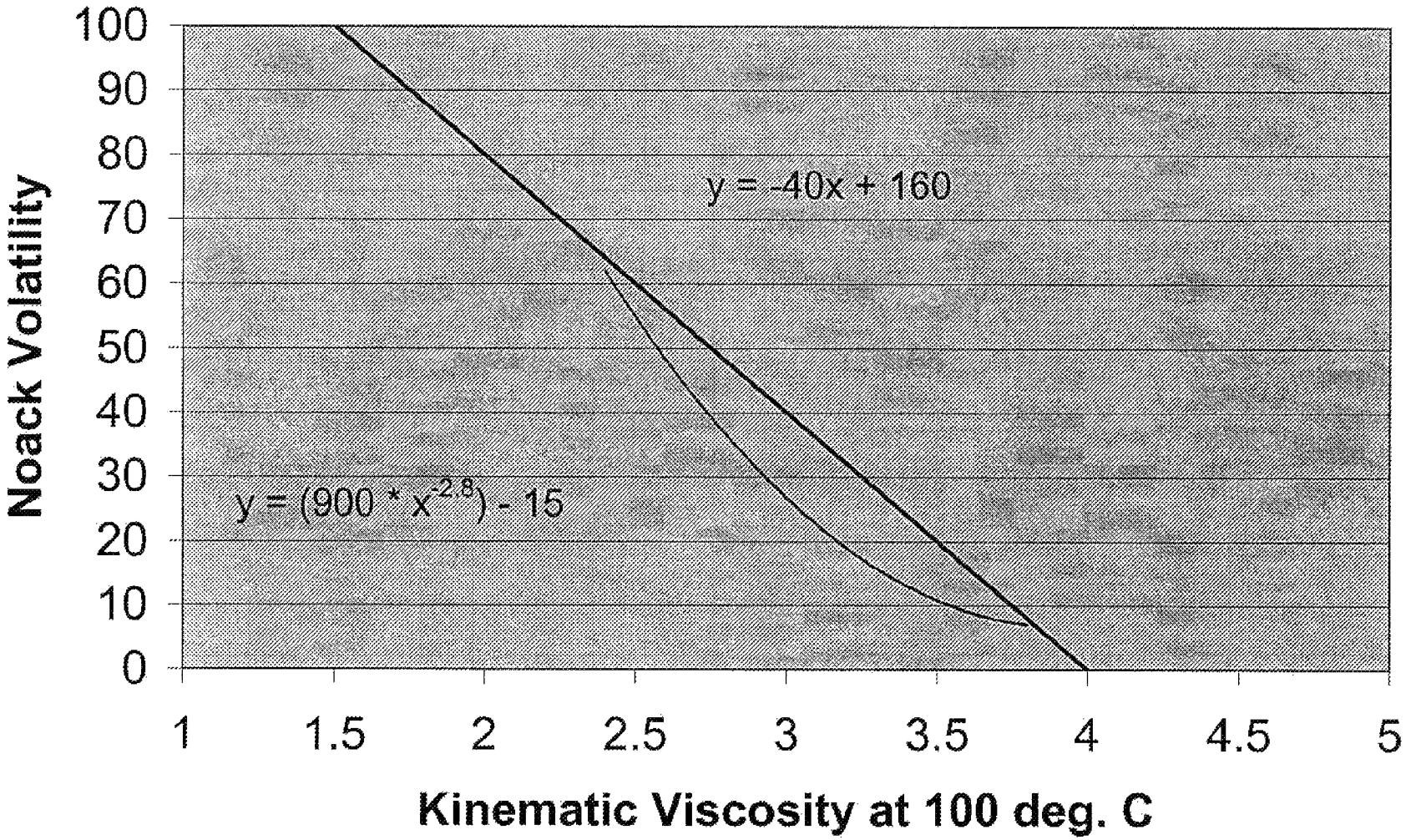

FIG. 3 illustrates the plots of Kinematic Viscosity at 100° C. vs. Noack Volatility, in Weight percent, providing the equations for calculation of the upper limits of wt % Noack Volatility of:

$$160\text{-}40\text{(Kinematic Viscosity at 100° C.), and}$$

$$900\times(\text{Kinematic Viscosity at 100° C.})^{-2.8}-15, \text{ wherein the Kinematic}$$

Viscosity at 100° C. is raised to the power of −2.8 in the second equation.

DETAILED DESCRIPTION OF THE INVENTION

Certain functional fluids, such as shock absorber fluids, must meet stringent OEM specificatiors. Examples of two such specifications for shock absorber fluids are Kayaba 0304-050-0002 and VW TL 731 class A. Selected requirements from these two specifications are summarized in Table I.

TABLE I

| Property | Test Method | Kayaba 0304-050-0002 | VW TL 731 class A |
|---|---|---|---|
| KV 100, $mm^2/s$ | ASTM D 445 | — | >2.5 |
| KV 40, $mm^2/s$ | ASTM D 445 | — | Report |
| Brookfield Vis @ −18° C., mPa · s | ASTM D 2983 | <390 | — |
| Brookfield Vis @ −30° C., mPa · s | ASTM D 2983 | <1200 | — |
| Aniline Point, ° C. | ASTM D 611 | >88 | — |
| Flash Point, ° C. | ASTM D 92 | >160 | — |
| Pour Point, ° C. | ASTM D 97 or equivalent | <−45 | |
| Evaporation Loss (1 hr/ 200° C.) | CEC-L43-A-93 modified | <20 | — |
| Copper Corrosion | ASTM D 130 | 1b max | — |
| Acid Number, mg KOH/g | ASTM D 664 | <2.2 | — |
| Foam, ml | ASTM D 893 | | |
| Sequence I | | — | ≦100/0 |
| Sequence II | | — | ≦100/0 |
| Sequence III | | — | ≦100/0 |
| Air Release, vol % | DIN 51381 | | |
| After 30 sec. | | — | ≦2.0 |
| After 1 minute | | — | ≦1.0 |
| After 1 minute 30 sec. | | — | ≦0.5 |
| After 2 minutes | | — | ≦0.2 |
| Oxidation Stability at 160° C., 96 hrs | CEC L-48-A-00 method B modified | | |
| Δ KV 100, % | (VW defined | — | ≦10 |
| Δ KV 40, % | conditions) | — | ≦10 |
| Δ TAN, mg KOH/g | | — | report[a] |
| Blotter Spot | | — | |
| Shear Stability KRL 20 hrs | CEC L-45-A-99 | | |
| KV 100 after shear, $mm^2/s$ | | — | ≧2.5 |
| Shear Loss, % | | — | ≦15 |
| Condition After Ageing, 140° C., 24 hrs | CEC L-48-A-00 method B modified | | |
| Sequence I Foam, ml | ASTM D 892 | — | ≦100/0 |
| Sequence II Foam, ml | ASTM D 892 | — | ≦100/0 |
| Air release after 30 s, vol % | DIN 51381 | — | ≦2.0 |
| Air release after 1 min | DIN 51381 | — | ≦1.0 |
| Air release after 1 min 30 s | DIN 51381 | — | ≦0.5 |
| Air release after 2 min | DIN 51381 | — | ≦0.2 |

[a]no solid or sticky residues

Shock absorber fluids with improved air release properties are highly desired. Dispersed air pockets in oil can increase compressibility and therefore cause shock absorbers to fail. DIN 51381 is the test method used to measure air release. To determine air release properties, the sample is heated to a specified test temperature, 50° C. and blown with compressed air. After the air flow is stopped, the time required for the air entrained in the oil to reduce in volume to 0.2% is the air bubble separation time. In the case of our air release testing we measured the volume percent of entrained air at different time periods of 30 seconds, 1 minute 1 minute 30 seconds, and 2 minutes.

The shock absorber fluid comprises low amounts of viscosity index improver and pour point depressant, reducing the cost of formulating the functional fluid. In one embodiment the functional comprises less than 4.0 wt %, based on the total composition, of combined viscosity index improver and pour point depressant. In other embodiments the shock absorber fluid comprises less than 3.0 wt % or less than 2.0 wt % combined viscosity index improver and pour point depressant. In one embodiment the functional fluid comprises essentially zero combined viscosity index improver and pour point depressant.

In one embodiment the shock absorber fluid has a kinematic viscosity at 100° C. less than 5 $mm^2/s$. In other embodiments the shock absorber fluid has a kinematic viscosity at 100° C. between 2.0 and 4.0 $mm^2/s$, between 2.4 and 3.4 $mm^2/s$, or greater than 2.5 $mm^2/s$.

The shock absorber fluid has a high viscosity index. In one embodiment the viscosity index of the shock absorber fluid is greater than or equal to 129. In other embodiments the viscosity index is greater than 150 or 175.

The shock absorber fluid has a Brookfield viscosity at −30° C. that is low. In one embodiment the Brookfield viscosity at −30° C. is less than 1,000 mPa·s. In other embodiments the Brookfield viscosity at −30° C. is less than 750 mPa·s, less than 500 mPa·s, or less than 250 mPa·s.

In one embodiment the shock absorber fluid additionally comprises a base oil made from a waxy feed. Because it is made from a waxy feed, the base oil has consecutive numbers of carbon atoms. By "consecutive numbers of carbon atoms" we mean that the base oil has a distribution of hydrocarbon molecules over a range of carbon numbers, with every number of carbon numbers in-between. For example, the base oil may have hydrocarbon molecules ranging from C22 to C36 or from C30 to C60 with every carbon number in-between. The hydrocarbon molecules of the base oil differ from each other by consecutive numbers of carbon atoms, as a consequence of the waxy feed also having consecutive numbers of carbon atoms. For example, in the Fischer-Tropsch hydrocarbon synthesis reaction the source of carbon atoms is CO and the hydrocarbon molecules are built up one carbon atom at a time. Petroleum-derived waxy feeds also have consecutive numbers of carbon atoms. In contrast to an oil based on PAO, the molecules of the base oil have a more linear structure, comprising a relatively long backbone with short branches. The classic textbook description of a PAO is a star-shaped molecule, and in particular tridecane, which is illustrated as three decane molecules attached at a central point. While a star-shaped molecule is theoretical, nevertheless PAO molecules have fewer and longer branches than the hydrocarbon molecules that make up the base oil used in this disclosure. In another embodiment the base oil having consecutive numbers of carbon atoms also has less than 10 wt % naphthenic carbon by n-d-M. In yet another embodiment the base oil made from a waxy feed has a kinematic viscosity at 100° C. between 1.5 and 3.5 $mm^2/s$.

In one embodiment the shock absorber fluid comprises an XLN grade of base oil or an XXLN grade. In another embodiment the shock absorber fluid comprises a mixture of XLN and XXLN grades of base oil. An XXLN grade of base oil, when referred to in this disclosure, is a base oil having a kinematic viscosity at 100° C. between about 1.5 $mm^2/s$ and about 3.0 $mm^2/s$, or between about 1.8 $mm^2/s$ and about 2.3 $mm^2/s$. An XLN grade of base oil is a base oil having a kinematic viscosity at 100° C. between about 1.8 $mm^2/s$ and about 3.5 $mm^2/s$, or between about 2.3 $mm^2/s$ and about 3.5 $mm^2/s$. A LN grade of base oil is a base oil having a kinematic viscosity at 100° C. between about 3.0 $mm^2/s$ and about 6.0 $mm^2/s$, or between about 3.5 $mm^2/s$ and about 5.5 $mm^2/s$. A MN grade of base oil is a base oil having a kinematic viscosity at 100° C. between about 5.0 $mm^2/s$ and about 15.0 $mm^2/s$, or between about 5.5 $mm^2/s$ and about 10.0 $mm^2/s$. A HN grade of base oil is a base oil having a kinematic viscosity at 100° C. above 10 $mm^2/s$. Generally, the kinematic viscosity of a HN grade of base at 100° C. will be between about 10.0 $mm^2/s$ and about 30.0 $mm^2/s$ or between about 15.0 $mm^2/s$ and about 30.0 $mm^2/s$.

In one embodiment the shock absorber fluid has an aniline point greater than 88° C. In another embodiment the shock absorber fluid comprises a base oil having a kinematic viscosity at 100° C. less than 3.0 $mm^2/s$, consecutive numbers of carbon atoms, less than 10 wt % naphthenic carbon, and a viscosity index greater than 121. The shock absorber fluid has a kinematic viscosity at 100° C. less than 5 $mm^2/s$ and an aniline point greater than or equal to 95° C. In other embodiments the shock absorber fluid has an aniline point greater than 100, 105, or 110° C. In yet another embodiment the shock absorber fluid has an air release after 1 minute by DIN 51381 of less than 0.8 vol % or less than 0.5 vol %.

The term "waxy feed" as used in this disclosure refers to a feed having a high content of normal paraffins (n-paraffins). A waxy feed will generally comprise at least 40 wt % n-paraffins, greater than 50 wt % n-paraffins, greater than 75 wt % n-paraffins, or greater than 85 wt % n-paraffins. In one embodiment the waxy feed has low levels of nitrogen and sulfur, generally less than 25 ppm total combined nitrogen and sulfur, or less than 20 ppm total combined nitrogen and sulfur. Examples of waxy feeds that may be used to make, base oils used in shock absorber fluids include slack waxes, deoiled slack waxes, refined foots oils, waxy lubricant raffinates, n-paraffin waxes, NAO waxes, waxes produced in chemical plant processes, deoiled petroleum derived waxes, microcrystalline waxes, Fischer-Tropsch waxes, and mixtures thereof. The pour points of the waxy feeds are generally greater than about 50° C. and in some embodiments greater than about 60° C.

Fischer-Tropsch waxes can be obtained by well-known processes such as, for example, the commercial SASOL® Slurry Phase Fischer-Tropsch technology, the commercial SHELL® Middle Distillate Synthesis (SMIDS) Process, or by the non-commercial EXXON® Advanced Gas Conversion (AGC-21) process. Details of these processes and others are described in, for example, FP-A-776959, EP-A-668342; U.S. Pat. Nos. 4,943,672, 5,059,299, 5,733,839, and RE39073; and US Published Application No. 2005/0227866, WO-A-9934917, WO-A-9920720 and WO-A-05107935. The Fischer-Tropsch synthesis product usually comprises hydrocarbons having 1 to 100, or even more than 100 carbon atoms, and typically includes paraffins, olefins and oxygenated products. Fischer Tropsch is a viable process to generate clean alternative hydrocarbon products, including Fischer-Tropsch waxes.

Slack wax can be obtained from conventional petroleum derived feedstocks by either hydrocracking or by solvent refining of the tube oil fraction. Typically, slack wax is recovered from solvent dewaxing feedstocks prepared by one of these processes. Hydrocracking is usually preferred because hydrocracking will also reduce the nitrogen content to a low value. With slack wax derived from solvent refined oils, deoiling may be used to reduce the nitrogen content. Hydrotreating of the slack wax can be used to lower the nitrogen and sulfur content. Slack waxes posses a very high viscosity index, normally in the range of from about 140 to 200, depending on the oil content and the starting material from which the slack wax was prepared. Therefore, slack waxes are suitable for the preparation of base oils made from a waxy feed used in shock absorber fluids.

In one embodiment the waxy feed has less than 25 ppm total combined nitrogen and sulfur. Nitrogen is measured by melting the waxy feed prior to oxidative combustion and chemiluminescence detection by ASTM D 4629-02. The test method is further described in U.S. Pat. No. 6,503,956, incorporated herein. Sulfur is measured by melting the waxy feed prior to ultraviolet fluorescence by ASTM D 5453-00. The test method is further described in U.S. Pat. No. 6,503,956, incorporated herein.

Determination of normal paraffins (n-paraffins) in wax-containing samples is performed using a method that determines the content of individual C7 to C110 n-paraffins with a limit of detection of 0.1 wt %. The method used is gas chromatography, described later in this disclosure.

Waxy feeds are expected to be plentiful and relatively cost competitive in the near future as large-scale Fischer-Tropsch synthesis processes come into production. The feedstock for a Fischer-Tropsch process may come from a wide variety of hydrocarbonaceous resources, including biomass, natural gas, coal, shale oil, petroleum, municipal waste, derivatives of these, and combinations thereof. Fischer-Tropsch derived base oils made from substantially paraffinic waxy feeds, and thus the shock absorber fluids comprising them, will be less expensive than lubricants made with other synthetic oils such as polyalphaolefins or esters. The term "Fischer-Tropsch derived" means that the product, fraction, or feed originates from or is produced at some stage by a Fischer-Tropsch process. Syncrude prepared from the FischerTropsch process comprises a mixture of various solid, liquid, and gaseous hydrocarbons. Those Fischer-Tropsch products which boil within the range of lubricating base oil contain a high proportion of substantially paraffinic wax which makes them ideal candidates for processing into base oil. Accordingly, Fischer-Tropsch wax presents an excellent feed for preparing high quality base oils. Fischer-Tropsch wax is normally solid at room temperature and, consequently, displays poor low temperature properties, such as pour point and cloud point. However, following hydroisomerization of the wax, Fischer-Tropsch derived base oils having excellent low temperature properties are prepared. Hydroisomerizing a waxy feed produced a product with increased branching and lower pour point. A general description of suitable hydroisomerization dewaxing processes may be found in U.S. Pat. Nos. 5,135,638 and 5,282,958; and US Patent Application 20050133409, incorporated herein.

The hydroisomerization is achieved by contacting the waxy feed with a hydroisomerization catalyst in an isomerization zone under hydroisomerizing conditions. The hydroisomerization catalysts in some embodiments comprises a shape selective intermediate pore size molecular sieve, a noble metal hydrogenation component, and a refractory oxide support. The shape selective intermediate pore size molecular sieve may be selected from the group consisting of SAPO-11, SAPO-31, SAPO-41, SM-3, ZSM-22, ZSM-23, ZSM-35, ZSM-48, ZSM-57, SSZ-32, offretite, ferrierite, and combinations thereof, SAPO-11, SM-3, SSZ-32, ZSM-23, ZSM-48, and combinations thereof are used in one embodiment. In one embodiment the noble metal hydrogenation component is platinum, palladium, or combinations thereof.

The hydroisomerizing conditions depend on the waxy feed used, the hydroisomerization catalyst used, whether or not the catalyst is sulfided, the desired yield, and the desired properties of the base oil. In one embodiment the hydroisomerizing conditions include temperatures of 260 degrees C. to about 413 degrees C. (500 to about 775 degrees F.), a total pressure of 15 to 3000 psig, and a hydrogen to feed ratio from about 2 to 30 MSCF/bbl, from about 4 to 20 MSCF/bbl (about 712.4 to about 3562 liter $H_2$/liter oil), from about 4.5 or 5 to about 10 MSCF/bbl, or from about 5 to about 8 MSCF/bbl. Generally, hydrogen will be separated from the product and recycled to the isomerization zone. Note that a feed rate of 10 MSCF/bbl is equivalent to 1781 liter H2/liter feed. Generally, hydrogen will be separated from the product and recycled to the isomerization zone.

Optionally, the base oil produced by hydroisomerization dewaxing may be hydrofinished. The hydrofinishing may occur in one or more steps, either before or after fractionating of the base oil into one or more fractions. The hydrofinishing is intended to improve the oxidation stability, UV stability, and appearance of the product by removing aromatics, olefins, color bodies, and solvents. A general description of hydrofinishing may be fund in U.S. Pat. Nos. 3,852,207 and 4,673,487, incorporated herein. The hydrofinishing step may be used to reduce the weight percent olefins in the base oil to less than 10, or even as low as less than 0.01. The hydrofinishing step may also be used to reduce the weight percent aromatics to less than 0.3 less than 0.1, or even as low as less than 0.01.

Optionally, the base oil produced by hydroisomerization dewaxing may be treated with an adsorbent such as bauxite or clay to remove impurities and improve the color and biodegradability.

The lubricating base oil is typically separated into fractions. In one embodiment one or more of the fractions will have a pour point less than 0° C., less than −9° C., less than −15° C., less than −20° C., less than −30° C., or less than −35° C. Pour point is measured by ASTM D 5950-02. In one embodiment the one or more fractions have a total weight percent of molecules with cycloparaffinic functionality greater than 5, 10, 20 or greater than or equal to 30. In one embodiment the one or more fractions have a ratio of weight percent molecules with monocycloparaffinic functionality to weight percent molecules with multicycloparaffinic functionality greater than 3, greater than 5, greater than 10) greater than 15, greater than 20, or even greater than 100. The lubricating base oil is optionally fractionated into different viscosity grades of base oil. The fractionating can be done at various stages of manufacture, including before hydroisomerization dewaxing, following hydroisomerization dewaxing, before hydrofinishing, or following hydrofinishing, for example. In the context of this disclosure "different viscosity grades of base oil" is defined as two or more base oils differing in kinematic viscosity at 100 degrees C. from each other by at least 0.5 $mm^2/s$. Kinematic viscosity is measured using ASTM D 445-06. Fractionating is done using a vacuum distillation unit to yield cuts with pre selected boiling ranges. One of the fractions may be a distillation bottoms product.

The base oil fractions have measurable quantities of unsaturated molecules measured by FIMS. In some embodiments the hydroisomerization dewaxing and fractionating conditions are tailored to produce one or more selected fractions of base oil having greater than 10 weight percent total molecules with cycloparaffinic functionality, for example greater than 20 weight percent, greater than 35 or greater than 40; and a viscosity index greater than 150. The one or more selected fractions of base oils will usually have less than 70 weight percent total molecules with cycloparaffinic functionality. Generally, the one or more selected fractions of base oil will additionally have a ratio of molecules with monocycloparaffinic functionality to molecules with multicycloparaffinic functionality greater than 2.1. In some embodiments there may be no molecules with multicycloparaffinic functionality, such that the ratio of molecules with monocycloparaffinic functionality to molecules with multicycloparaffinic functionality is greater than 100.

In one embodiment, the base oil factions have less than 10 wt % or less than 5 wt % naphthenic carbon. In another embodiment the base oil fractions have between about 1 or 2 wt % and about 5 or 10 wt % naphthenic carbon. In one embodiment, the base oil fraction has a kinematic viscosity of 1.5 $mm^2/s$ to about 3.0 $mm^2/s$ at 100° C. and 2-3 wt % naphthenic carbon. In another embodiment, the base oil fraction has a kinematic viscosity of 1.8 $mm^2/s$ to about 3.5 $mm^2/s$ at 100° C. and 2.5-4 wt % naphthenic carbon. In a third embodiment, the base oil fraction has a kinematic viscosity of 3 $mm^2/s$ to about 6 $mm^2/s$ at 100° C. and 2.7-5 wt % naphthenic carbon.

The base oil fractions have low Noack volatility. Noack volatility is usually tested according to ASTM D5800-05, Procedure B, Another method for calculating Noack volatility and one which correlates well with ASTM D5800-05 is by using a thermogravimetric analyzer (TGA) test by ASTM 96375-05. In one embodiment, the base oil fractions have a Noack volatility Of less than 100 weight %. The "Noack Volatility Factor" of the base oil derived from highly paraffinic wax is an empirical number derived from the kinematic viscosity of the base oil fraction. In one embodiment the Noack volatilities of the base oil fractions are between 0 and 100, and less than an amount calculated by the equation: Noack Volatility Factor=160-40(Kinematic Viscosity at 100° C.). In this embodiment the base oil fraction has a kinematic viscosity at 100° C. between 1.5 and 4.0 $mm^2/s$. The plot of the Noack Volatility Factor is shown in FIG. 3.

In another embodiment the kinematic viscosity at 100° C. of the base oil fraction is between 2.4 and 3.8 $mm^2/s$ and the Noack volatility of the base oil fraction is less than an amount calculated by the equation: 900×(kinematic viscosity at 100° C.)$^{-2.8}$−15. The plot of this alternative upper limit for Noack volatility is shown in FIG. 3.

Figure 1:
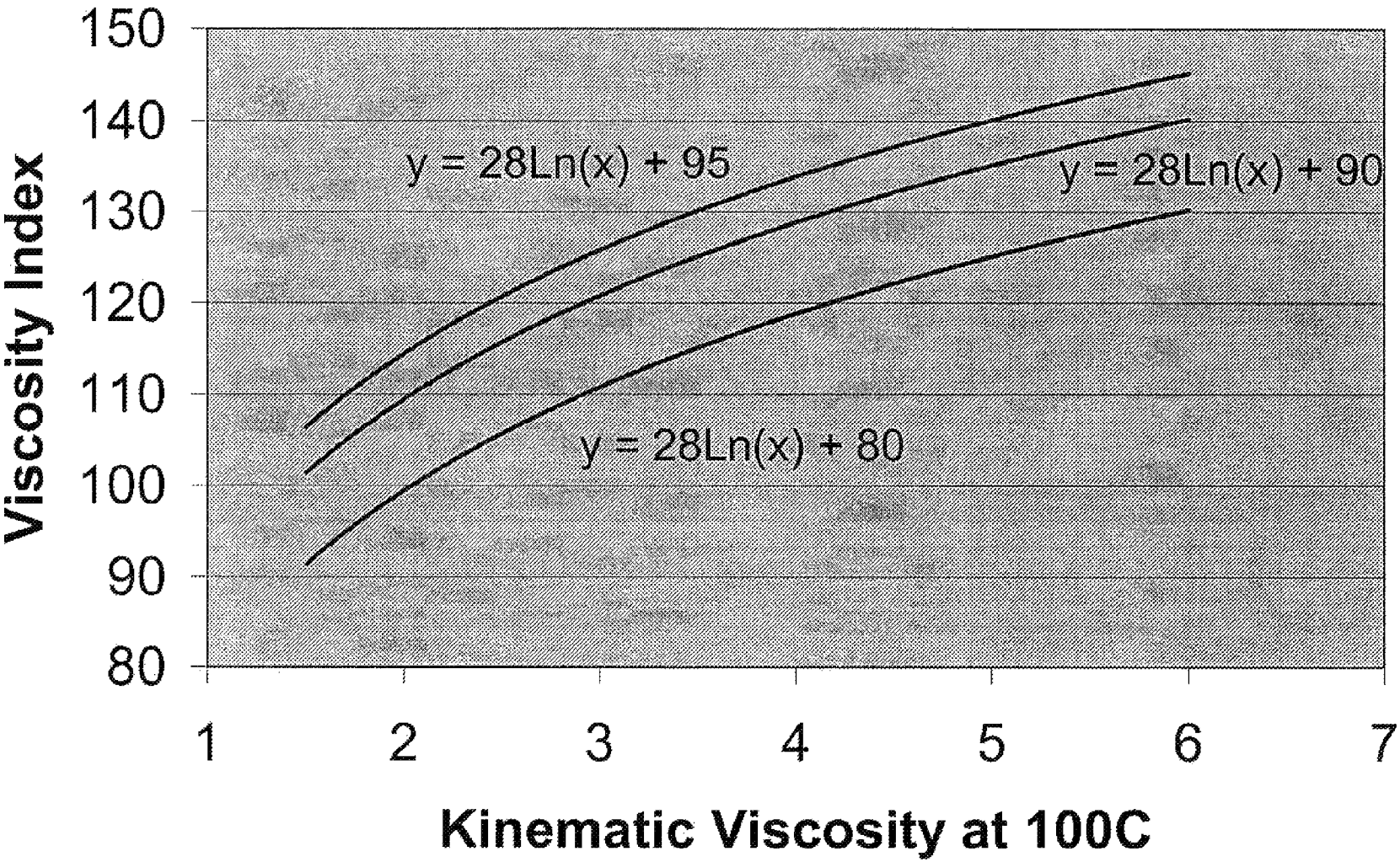

The viscosity index of the lubricating base oil fraction of the shock absorber fluid is high. In one embodiment the viscosity index of the base oil fraction is greater than 28×Ln (Kinematic Viscosity at 100° C.)+80. In another embodiment the base has a viscosity index such that X in the equation: viscosity index=28×Ln(Kinematic Viscosity at 100° C.+X, is greater than 90 or 95. For example, an oil with a kinematic viscosity of 2.5 $mm^2/s$ at 100° C. will have a viscosity index greater than 105, 115, or 120; and a 5 $mm^2/s$ oil will have a viscosity index greater than 125, 135, or 140. The plots of these three alternative lower limits for viscosity index are shown in FIG. 1.

In another embodiment the lubricating base oil fraction has a pour point of less than −8° C.; a kinematic Viscosity at 100° C. of at least 1.5 $mm^2/s$; and a viscosity index greater than an amount calculated by the equation: 22×Ln (Kinematic Viscosity at 10° C.)+132. In this embodiment, for example, an oil with a kinematic viscosity of 2.5 $mm^2/s$ at 100° C. will have a viscosity index greater than 152. Base oils with these properties are described in US Patent Publication US20050077208. A plot of this embodiment of the lower limit for viscosity index is shown in FIG. 2.

The test method used to measure viscosity index is ASTM D 2270-04. The term "Ln" in the context of equations in this disclosure refers to the natural logarithm with base 'e'.

In one embodiment the presence of predominantly cycloparaffinic molecules with monocycloparaffinic functionality in the base oil fractions provides excellent oxidation stability, low Noack volatility, as well as desired additive solubility and elastomer compatibility. The base oil fractions have a weight percent olefins less than 10 less than 5, less than 1, and in other embodiments less than 0.5 less than 0.05, or less than 0.01. In some embodiments, the base oil fractions have a weight percent aromatics less than 0.1, less than 0.05, or less than 0.02.

In some embodiments, the base oil fractions have a traction coefficient less than 0.023, less than or equal to 0.021, or less than or equal to 0.019, when measured at a kinematic viscosity of 15 $mm^2/s$ and at a slide to roll ratio of 40 percent. They have a traction coefficient less than an amount defined by the equation: traction coefficient=0.009×Ln(Kinematic Viscosity)−0.001, wherein the Kinematic Viscosity during the traction coefficient measurement is between 2 and 50 $mm^2/s$; and wherein the traction coefficient is measured at an average rolling speed of 3 meters per second, a slide to roll ratio of 40 percent, and a load of 20 Newtons. In one embodiment the base oil fractions have a traction coefficient less than 0.015 or 0.011, when measured at a kinematic viscosity of 15 $mm^2/s$ and at a slide to roll ratio of 40 percent. Examples of these base oil fractions with low traction coefficients are taught in U.S. Pat. No. 7,045,055 and U.S. patent application Ser. No. 11/400,570, filed Apr. 7, 2006. Shock absorber fluids made with base oil fractions having low traction coefficients give low wear and extended service life.

In some embodiments, where the olefin and aromatics contents are significantly low in the lubricant base oil fraction of the lubricating oil, the Oxidator BN of the selected base oil fraction will be greater than 25 hours, such as greater than 35 hours or even greater than 40 hours. The Oxidator BN of the selected base oil fraction will typically be less than 70 hours. Oxidator BN is a convenient way to measure the oxidation stability of base oils. The Oxidator BN test is described by Stangeland et al. in U.S. Pat. No. 3,852,207 The Oxidator SN test measures the resistance to oxidation by means of a Dornte-type oxygen absorption apparatus. See R. W. Dornte "Oxidation of White Oils." Industrial and Engineering Chemistry, Vol. 28, page 26, 1936. Normally, the conditions are one atmosphere of pure oxygen at 340° F. The results are reported in hours to absorb 1000 ml of O2 by 100 g. of oil. In the Oxidator BN test, 0.8 ml of catalyst is used per 100 grams of oil and an additive package is included in the oil. The catalyst is a mixture of soluble metal naphthenates in kerosene. The mixture of soluble, metal naphthenates simulates the average metal analysis of used crankcase oil. The level of metals in the catalyst is as follows: Copper=6,927 ppm; Iron=4,083 ppm; Lead=80,208 ppm; Manganese=350 ppm; Tin=3565 ppm. The additive package is 80 millimoles of zinc bispolypropylenephenyldithio-phosphate per 100 grams of oil, or approximately 1.1 grams of OLOA 260. The Oxidator BN test measures the response of a lubricating base oil in a simulated application. High values, or long times to absorb one liter of oxygen, indicate good oxidation stability. Shock absorber fluid comprising a base oil fraction having good oxidation stability will also have improved oxidation stability.

OLOA™ is an acronym for Oronite Lubricating Oil Additive, which is a registered trademark of Chevron Oronite.

In some embodiments the one or more lubricating base oil fractions will have excellent biodegradability. With suitable hydro-processing and/or adsorbent treatment they are readily biodegradable by the OECD 301B Shake Flask Test (Modified Sturm Test). When the readily biodegradable base oil fractions are blended with suitable biodegradable additives, such as selected low-ash or ashless additives, the lubricants will provide rapid biodegradation of spills in sensitive areas with minimal non-biodegradable residue and will prevent costly environmental clean-up.

Aniline Point:

The aniline point of a lubricating base oil is the temperature at which a mixture of aniline and oil separates. ASTM D 611-01b is the method used to measure aniline point. It provides a rough-t indication of the solvency of the oil for materials which are in contact with the oil, such as additives and elastomers. The lower the aniline point the greater the solvency of the oil.

In one embodiment the aniline point of the lubricating base oil will tend to very depending on the kinematic viscosity of the lubricating base oil at 100° C. in $mm^2/s$. In one embodiment, the aniline point of the lubricating base is less than a function of the kinematic viscosity at 100° C. In one embodiment, the function for aniline point is expressed as follows: Aniline Point, ° F.$\leqq$36×Ln (Kinematic Viscosity at 100° C.)+200.

In another embodiment the aniline point of the shock absorber fluid is greater than 88° C., or greater than or equal to 95° C.

Foam Tendency and Stability:

Foam tendency and stability are measured by ASTM D 892-03. ASTM D 892-03 measures the foaming characteristics of a lubricating base oil or finished lubricant at 24 degrees C. and 93.5 degrees C. It provides a means of empirically rating the foaming tendency and stability of the foam. The test oil, maintained at a temperature of 24 degrees C., is blown with air at a constant rate for 5 minutes then allowed to settle for 10 minutes. The volume of foam, in ml, is measured at the end of both periods (sequence I). The foaming tendency is provided by the first measurement, the foam stability by the second measurement. The test is repeated using a new portion of the test oil at 93.5 degrees C. (sequence II); however the settling time is reduced to one minute. For ASTM D 892-03 sequence III the same sample is used from sequence II, after the foam has collapsed and cooled to 24 degrees C. The test oil is blown with dry air for 5 minutes, and then settled for 10 minutes. The foam tendency and stability are again measured, and reported in ml. A good quality shock absorber fluid will generally have less than 100 ml foam tendency for each of sequence I, II, and III, and zero ml foam stability for each of sequence I, II, III; the lower the foam tendency of a lubricating base oil or shock absorber fluid the better. In one embodiment the shock absorber fluid has a much lower foaming tendency than typical shock absorber fluids. In some embodiments they have a sequence I foam tendency less than 50 ml; they have a sequence II foam tendency less than 50 ml, or less, than 30 ml; and in some embodiments they have a sequence III foam tendency less than 50 ml.

Foaming will vary in different base oils but can be controlled by the addition of antifoam agents. In one embodiment, the shock absorber fluids are blended with little to no antifoam agent, typically less than 0.2 wt %. However, shock absorber fluids of a higher viscosity or additionally comprising other base oils may exhibit foaming, Examples of antifoam agents are silicone oils, polyacrylates, acrylic polymers, and fluorosilicones.

Additives:

The additives for use in base oils to provide functional fluids (such as power steering fluids shock absorber fluids, and transmission fluids) include additives selected from the group consisting of viscosity index improvers, pour point depressants, detergents, dispersants, fluidizing agents, friction modifiers, corrosion inhibitors, rust inhibitors, antioxidants, detergents, seal swell agents, antiwear additives, extreme pressure (EP) agents, thickeners, friction modifiers, colorants, color stabilizers, antifoam agents, corrosion inhibitors, rust inhibitors, seal swell agents, metal deactivators, deodorizers, demulsifiers, and mixtures thereof. In one embodiment, an effective amount of at least one additive is blended with a base oil to make the functional fluid. An "effective amount" is an amount required, to achieve a desired effect.

The additives may be in the form of a lubricant additive package, which comprises several additives to provide a shock absorber fluid with desirable properties Lubricant additive packages for use in base oils to provide shock absorber fluids include lubricant additive packages selected from the group consisting of viscosity index improvers, pour point depressants, detergent-inhibitor (DI) packages, and mixtures thereof.

Viscosity Index Improvers

Viscosity index improvers modify the viscometric characteristics of lubricants by reducing the rate of thinning with increasing temperature and the rate of thickening with low temperatures. Viscosity index improvers thereby provide enhanced performance at low and high temperatures. In many applications, viscosity index improvers are used in combination with detergent-inhibitor additive packages to provide a shock absorber fluid.

The viscosity index improvers can be selected from the group consisting of olefin copolymers, co-polymers of ethylene and propylene, polyalkylacrylates, polyalkylmethacrylates, styrene esters, polyisobutylene, hydrogenated styrene-isoprene copolymers, star polymers, including those having tetrablock copolymer arms of hydrogenated polyisoprene-polybutadiene-polyisoprene with a block of polystyrene, or hydrogenated asymmetric radial polymers having molecules with a core composed of the remnant of a tetravalant silicon coupling agent, a plurality of rubbery arms comprising polymerized diene units and a block copolymer arm having at least one polymerized diene, block and a polymerized monovinyl aromatic compound block, hydrogenated styrene-butadienes, and mixtures thereof. In one embodiment, the viscosity index improver is an ethylene/a-olefin interpolymer as described in WO2006102146, wherein the ethylene/a-olefin interpolymer is a block copolymer having at least a hard block and at least a soft block. The soft block comprises a higher amount of comonomers than the hard block. In another embodiment the viscosity index improver is an acrylic acid ester polymer comprising a copolymer derived from 1-4C acrylic acid ester monomer, 12-14C acrylic acid ester monomer and 16-20C acrylic acid ester monomer, as described in US20060252660, wherein the copolymer has weight average molecular weight of 20,000-100,000 deltons, and contains 1 wt % or less of unreacted monomer.

Pour Point Depressants

Pour point depressants used in shock absorber fluids modify the wax crystal morphology such as to reduce interlocking of the wax crystals with consequent viscosity increase or gellation. Examples of pour point depressants are alkylated naphthalene and phenolic polymers, polymethacrylates, alkylated bicyclic aromatics, maleatelfumarate copolymer esters, methacylate-vinyl pyrrolidone copolymers styrene esters, polyfumerates, vinyl acetate-fumarate co-polymers, dialkyl esters of phthalate acid, ethylene vinyl acetate compolyers, and other mixed hydrocarbon polymers from commercial additive suppliers such as LUBRIZOL, the ETHYL Corporation, or ROHMAX, a Division of Degussa.

Pour Point Reducing Blend Component

In some embodiments a base oil pour point reducing blend component may be used. As used herein, "pour point reducing blend component" refers to an isomerized waxy product with relatively high molecular weights and a specified degree of alkyl branching in the molecule, such that it reduces the pour point of lubricating base oil blends containing it. Examples of a pour point reducing blend component are disclosed in U.S. Pat. Nos. 6,150,577 and 7,053,254, and Patent Publication No. US 2005-0247600 A1. A pour point reducing blend component can be: 1) an isomerized Fischer-Tropsch derived bottoms product; 2) a bottoms product prepared from an isomerized highly waxy mineral oil, or 3) an isomerized oil having a kinematic viscosity at 100° C. of at least about 8 $mm^2/s$ made from polyethylene plastic.

In one embodiment, the pour point reducing blend component is an isomerized Fischer-Tropsch derived vacuum distillation bottoms product having an average molecular weight between 600 and 1100 and an average degree of branching in the molecules between 6.5 and 10 alkyl branches per 100 carbon atoms. Generally, the higher molecular weight hydrocarbons are more effective as pour point reducing blend components than the lower molecular weight hydrocarbons. In one embodiments a higher cut point in a vacuum distillation unit which results in a higher boiling bottoms material is used to prepare the pour point reducing blend component. The higher cut point also has the advantage of resulting in a higher yield of the distillate base oil fractions. In one embodiment, the pour Point reducing blend component is an isomerized Fischer-Tropsch derived vacuum distillation bottoms product having a pour point that is at least 3° C. higher than the pour point of the distillate base oil it is blended with.

In one embodiment, the 10 percent point of the boiling range of the pour point reducing blend component that is a vacuum distillation bottoms product is between about 850° F.-1050° F. (454-565° C.) In another embodiment, the pour point reducing blend component is derived from either Fischer-Tropsch or petroleum products, having a boiling range above 950° F. (510° C.), and contains at least 50 percent by weight of paraffins. In yet another embodiment the pour point reducing blend component has a boiling range above 1050° F. (565° C.).

In another embodiment, the pour point reducing blend component is an isomerized petroleum derived base oil containing material having a boiling range above about 1050° F. In one embodiment, the isomerized bottoms material is solvent dewaxed prior to being used as a pour point reducing blend component. The waxy product further separated during solvent dewaxing from the pour point reducing blend component were found to display excellent improved pour point depressing properties compared to the oily product recovered after the solvent dewaxing.

In another embodiment, the pour point reducing blend component is an isomerized oil having a kinematic viscosity at 100° C. of at least about 8 $mm^2/s$ made from polyethylene plastic. In one embodiment the pour point reducing blend component is made from waste plastic. In another embodiment the pour point reducing blend component is made from steps comprising pyrolysis of polyethylene plastic, separating out a heavy fraction, hydrotreating the heavy fraction, catalytic isomerizing the hydrotreated heavy fraction, and collecting the pour point reducing blend component having a kinematic viscosity at 100° C. of at least about 8 $mm^2/s$. In a third embodiment, the pour point reducing blend component derived from polyethylene plastic and has a boiling range above 1050° F. (565° C.), or even has a boiling range above 1200° F. (649° C.).

In one embodiment, the pour point reducing blend component has an average degree of branching in the molecules within the range of from 6.5 to 10 alkyl branches per 100 carbon atoms. In another embodiment, the pour point reducing blend component has an average molecular weight between 600-1100. In a third embodiment it has an average molecular weight between 700-1000. In one embodiment, the pour point reducing blend component has a kinematic viscosity at 100° C. of 8-30 $mm^2/s$, with the 10% point of the boiling range of the bottoms falling between about 850-1050° F. In yet another embodiment, the pour point reducing blend component has a kinematic viscosity at 100° C. of 15-20 $mm^2/s$ and a pour point of −8 to −12° C.

In one embodiment, the pour point reducing blend component is an isomerized oil having a kinematic viscosity at 100° C. of at least about 8 $mm^2/s$ made from polyethylene plastic. In one embodiment the pour point reducing blend; component is made from waste plastic. In another embodiment the pour point reducing blend component is made from steps comprising pyrolysis of polyethylene plastic, separating out a heavy fraction, hydrotreating the heavy fraction, catalytic isomerizing the hydrotreated heavy fraction, and collecting the pour point reducing blend component having a kinematic viscosity at 100° C. of at least about 8 $mm^2/s$. In a third embodiment, the pour point reducing blend component derived from polyethylene plastic has a boiling range above 1050° F. (565° C.), or even a boiling range above 1200° F. (649° C.)

Detergent-Inhibitor Packages

Detergent-inhibitor packages serve to suspend oil contaminants, as well as to prevent oxidation of the shock absorber fluids with the resultant formation of varnish and sludge deposits. The detergent-inhibitor (DI) package useful in shock absorber fluids contains one or more conventional additives selected from the group consisting of dispersants, fluidizing agents, friction modifiers, corrosion inhibitors, rust inhibitors, antioxidants, detergents, seal swell agents, extreme pressure additives, antiwear additives, deodorizers, antifoam agents, demulsifiers, colorants, and color stabilizers. The detergent-inhibitor package is present in an amount of from 2 to 25 weight percent, based on the total weight of the shock absorber fluid composition. Detergent-inhibitor packages are readily available from additive suppliers such as LUBRIZOL, ETHYL, Oronite, and INFINEUM. A number of detergent-inhibitor additives are described in EP0978555A1.

Dispersants

Dispersants are used in shock absorber fluids to disperse wear debris and products of lubricant degradation within the equipment being lubricated, such as in the power steering equipment or shock absorber.

The ashless dispersants commonly used contain a lipophilic hydrocarbon group and a polar functional hydrophilic group. The polar functional group can be of the class of carboxylate, ester, amine, amide, imine, imide, hydroxyl, ether, epoxide, phosphorus, ester carboxyl, anhydride, or nitrite. The lipophilic group can be oligomeric or polymeric in nature, usually from 70 to 200 carbon atoms to ensure good oil solubility. Hydrocarbon polymers treated with various reagents to introduce polar functions include products prepared by treating polyolefins such as polyisobutene first with maleic anhydride, or phosphorus sulfide or chloride, or by thermal treatment, and then with reagents such as polyamine, amine, ethylene oxide, etc.

Of these ashless dispersants the ones typically used in shock absorber fluids include N-substituted polyisobutenyl succinimides and succinates, alkyl methacrylate-vinyl pyrrolidinone copolymers, alkyl methacrylate-dialkylaminoethyl methacrylate copolymers, alkylmethacrylate-polyethylene glycol methacrylate copolymers, and polystearamides. Some oil-based dispersants that are used in shock absorber fluids include dispersants from the chemical classes of alkylsuccinimide, succinate esters, high molecular weight amines, and Mannich base and phosphoric acid derivatives. Some specific examples are polyisobutenyl succinimide-polyethylencpolyamine, polyisobutenyl succinic ester, polyisobutenyl hydroxybenzyl-polyethylencpolyamine, bis-hydroxypropyl phosphorate. Commercial dispersants suitable for shock absorber fluid are for example, LUBRIZOL 890 (an ashless PIB succinimide), LUBRIZOL 6420 (a high molecular weight PIB succinimide), and ETHYL HITEC 646 (a non-boronated PIB succinimide). The dispersant may be combined with other additives used in the lubricant industry to form a dispersant-detergent (DI) additive package for shock absorber fluid, e.g., LUBRIZOL 9677 MX, and the whole DI package can be used as the dispersing agent.

Alternatively a surfactant or a mixture of surfactants with low HLB value (typically less than or equal to 8), preferably nononic, or a mixture of nonionics and ionics, may be used as the dispersants in the shock absorber fluid.

The dispersants selected should be soluble or dispersible in the liquid medium or additive diluent oil. The dispersant can be in a range of up from 0.01 to 30 percent and all sub-ranges therebetween, for example in a range of from between 0.5 percent to 20 percent, a range of from between 1 to 15 percent, or in a range of from between 2 to 13 percent as active ingredient in the shock absorber fluid Fluidizing Agents Fluidizing agents are sometimes used in shock absorber fluids. Suitable fluidizing agents include oil-soluble diesters. Examples of diesters include the adipates, azelates, and sebacates of C8-C13 alkanols (or mixtures thereof), and the phthalates of C4-C13 alkanols (or mixtures thereof). Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acids and the n-butyl, isobutyl, pentyl, hexyl, heptyl, octyl, nonyl, decyl, undecyl, dodecyl, and tridecyl diesters of phthalic acid. Other esters which are used as fluidizing agents in shock absorber fluids are polyol esters such as EMERY 2918, 2939 and 2995 esters from the EMERY Group of Henkel Corporation and HATCOL 2926, 2970 and 2999.

Thickeners

Other thickeners, besides viscosity index improvers, which can be used in the shock absorber fluid include: acrylic polymers such as polyacrylic acid and sodium polyacrylate, high-molecular-weight polymers of ethylene oxide such as Polyox WSR from Union Carbide, cellulose compounds such as carboxymethylcellulose, polyvinyl alcohol (PVA), polyvinyl pyrrolidone (PVP), xanthan gums and guar gums, polysaccharides, alkanolamides, amine salts of polyamide such as DISPARLON AQ series from King Industries, hydrophobically modified ethylene oxide urethane (e.g., ACRYSOL series from Rohmax), silicates, and fillers such as mica, silicas cellulose, wood flour, clays (including organoclays) and clays, and resin polymers such as polyvinyl butyral resins, polyurethane resins, acrylic resins and epoxy resins.

Other examples of thickeners are polyisobutylene, high molecular weight complex ester, butyl rubber, olefin, copolymers, styrene-diene polymer, polymethacrylate, styrene-ester, and ultra high viscosity PAO. An example of a high molecular weight complex ester is Priolube® 3986. To achieve thickening and also impart low traction coefficient properties an ultra high viscosity PAO may also be used in the formulation. As used in this disclosure, an "ultra high viscosity PAO" has a kinematic viscosity between about 150 and 1,000 $mm^2/s$ or higher at 100 degrees C.

Friction Modifiers

Friction modifiers are optionally used in shock absorber fluids. Suitable friction modifiers include such compounds as aliphatic amines or ethoxylated aliphatic amines, aliphatic fatty acid amides aliphatic carboxyl acids, aliphatic carboxylic esters, aliphatic carboxylic ester-amides, aliphatic phosphonates, aliphatic phosphates, aliphatic thiophosphonates, aliphatic thiophosphates, or mixtures thereof. The aliphatic group typically contains at least about eight carbon atoms so as to render the compound suitably oil soluble. Also suitable are aliphatic substituted succinimides formed by reacting one or more aliphatic succinic acids or anhydrides with ammonia.

One group of friction modifiers is comprised of the N-aliphatic hydrocarbyl-substituted diethanol amines in which the N-aliphatic hydrocarbyl-substituent is at least one straight chain aliphatic hydrocarbyl group free of acetylenic unsaturation and having in the range of about 14 to about 20 carbon atoms. Another group of friction modifiers is comprised of esters of fatty acids, for example CENWAX™ TGA-185 and glycerol esters of selected fatty acids such as UNIFLEX™ 1803, both made by Arizona Chemical Other fatty acids used as friction modifiers are mono-oleates such as glycerol mono-oleate, pentaerythritoi mono-oleate, and sorbitan mono-oleate sold under the tradename of RADIASURF™ by OLEON.

Friction modifiers will sometimes include a combination of at least one N-aliphatic hydrocarbyl-substituted diethanol amine and at least one N-aliphatic hydrocarbyl-substituted trimethylene diamine in which the N-aliphatic hydrocarbyl-substituent is at least one straight chain aliphatic hydrocarbyl group free of acetylenic unsaturation and having in the range of about 14 to about 20 carbon atoms. Further details concerning this friction modifier combination are set forth in U.S. Pat. Nos. 5,372,735 and 5,441,656.

Another example of a mixture of friction modifiers is based on the combination of (i) at least one di(hydroxyalkyl) aliphatic tertiary amine in which the hydroxyalkyl groups, being the same or different, each contain from 2 to about 4 carbon atoms, and in which the aliphatic group is an acyclic hydrocarbyl group containing from about 10 to about 25 carbon atoms, and (ii) at least one hydroxyalkyl aliphatic imidazoline in which the hydroxyalkyl group contains from 2 to about 4 carbon atoms, and in which the aliphatic group is an acyclic hydrocarbyl group containing from about 10 to about 25 carbon atoms. Further details concerning this friction modifier system are found in U.S. Pat. No. 5,344,579.

Another class of friction modifiers that is sometimes used in shock absorber fluids include compounds of the formula: in which Z is a group R1R2CH—, in which R1 and R2 are each independently straight- or branched-chain hydrocarbon groups containing from 1 to 34 carbon atoms and the total number of carbon atoms in the groups R1 and R2 is from 11 to 35. The radical Z is, for example, 1-methylpentadecyl, 1-propyltridecenyl, 1-pentyltridecenyl, 1-tridecenylpentadecenyl or 1-tetradecyleicosenyl. These compounds are commercially available or are made by the application or adaptation of known techniques (see, for example, EP 0020037 and U.S. Pat. Nos. 5,021,176, 5,190,680 and RE-34,459).

The use of friction modifiers is optional. However, in applications where friction modifiers are used, the shock absorber fluid will contain up to about 1.25 wt %, such as from about 0.05 to about 1 wt % of one or more friction modifiers.

Corrosion Inhibitors

Corrosion inhibitors are another class of additives suitable for inclusion in shock absorber fluids. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis (hydrocarbylthio)-1,3,4-thiadiazoles, and 2,5-bis (hydrocarbyldithio)-1,3,4-thiadiazoles. Corrosion inhibitors of these types that are available on the open market include Cobratec TT-100 and HITEC®314 additive and HITEC®4313 additive (ETHYL Petroleum Additives, Inc.).

Rust Inhibitors

Rust inhibitors comprise another type of inhibitor additive for use in this invention. Some rust inhibitors are also corrosion inhibitors. Examples of rust inhibitors useful in shock absorber fluids are monocarboxylic acids and polycarboxylic acids. Examples of suitable monocarboxylic acids are octanoic acid, decanioic acid and dodecanoic acid. Suitable polycarboxylic acids include dimer and trimer acids such as are produced from such acids as tall oil fatty acids, oleoic acid, linoleic acid, or the like. Products of this type are currently available from various commercial sources, such as, for example, the dimer and trimer acids sold under the HYSTRENE™ by the Humko Chemical Division of Witco Chemical Corporation and under the EMPOL trademark by Henkel Corporation. Another useful type of rust inhibitor for use in shock absorber fluid is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Another suitable rust inhibitor is a rust inhibitor comprising a solubility improver having an aniline point less than 100° C.; a mixture of amine phosphates; and an alkenyl succinic compound selected from the group consisting of an acid half ester, an anhydride, an acid, and mixtures thereof as taught in U.S. patent application Ser. No. 11/257,900, filed on Oct. 25, 2005. Other suitable rust or corrosion inhibitors include ether amines; acid phosphates, amines polyethoxylated compounds such as ethoxylated amines, ethoxylated phenols, and ethoxylated alcohols; imidazolines; aminosuccinic acids or derivatives thereof, and the like. Materials of these types are available as articles of commerce. Mixtures of rust inhibitors can be used.

Antioxidants

Suitable antioxidants include phenolic antioxidants, aromatic amine antioxidants, sulfurized phenolic antioxidants, hindered phenolic antioxidants, molybdenum containing compounds, zinc dialkyldithiophosphates, and organic phosphites, among others. Mixtures of different types of antioxidants are often used. Examples of phenolic antioxidants include ionol derived hindered phenols, 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol) mixed methylene-bridged polyalkyl phenols, 4,4'-thiobis(2-methyl-6-tert-butylphenol), and sterically hindered tertiary butylated phenols. N,N'-di-sec-butyl-p-phenylenediamine, 4-isopropylaminodiphenyl amine, phenyl-naphthyl amine, phenyl-naphthyl amine, styrenated diphenylamine, and ring-alkylated diphenylamines serve as examples of aromatic amine antioxidants. In one embodiment the antioxidant is a catalytic antioxidant comprising one or more oil soluble organo metallic compound(s) and/or organo metallic coordination complexes such as metal(s) or metal cation(s) having more than one oxidation state above the ground state complexed, bonded or associated with two or more anions, one or more bidentate or tridentate ligands and/or two or more anions and ligand(s), as described in US20060258549.

Detergents

Examples of detergents that may be used in shock absorber fluids are over-based metallic detergents, such as the phosphonate, sulfonate, phenolate or salicylate types as described in Kirk-Othmer Encyclopedia of Chemical Technology, third edition, volume 14, pages 477-526.

Seal Swell Agents

A number of seal swell agents useful in shock absorber fluids are described in US Patent Publication US20030119682A1 and US20070057226A1. Examples of seal swell agents are aryl esters, long chain alkyl ether, alkyl esters, vegetable based esters, sebacate esters, sulfolanes, substituted sulfolane, other sulfolane derivatives, phenates, adipatest, glyceryl tri(acetoxystearate), epoxidized soybean oil, epoxidized linseed oil, N, n-butyl benzene sulformamide, aliphatic polyurethane, polyester glutarate, triethylene glycol caprate/caprylate, dialkyl diester glutarate, monomeric, polymer, and epoxy plasticizers, phthalate plasticizers, such as dioctyl phthalate, dinonly phthalate or dihexylpthalate, or oxygen-, sulfur-, or nitrogen-containing polyfunctional nitriles, phenates, and combinations thereof. Other plasticizers which may be substituted for and/or used with the above plasticizers including glycerine, polyethylene glycol, dibutyl phthalate, and 2,2,4-trimethyl-1,3-pentanediol monoisobutyrate, and diisononyl phthalate all of which are soluble in a solvent carrier. Other seal swelling agents such as LUBRIZOL 730 can also be used.

Antiwear and/or Extreme Pressure Additives

Various types of sulfur-containing antiwear and/or extreme pressure additives can be used in shock absorber fluids. Examples include dihydrocarbyl polysulfides; sulfurized olefins; sulfurized fatty acid esters of both natural and synthetic origins; trithiones; sulfurized thienyl derivatives; sulfurized terpenes sulfurized oligomers of C2-C8 monoolefins; and sulfurized Diels-Alder adducts such as those disclosed in U.S. reissue Pat. Re 27,331. Specific examples include sulfurized polyisobutene, sulfurized isobutylene, sulfurized diisobutylene, sulfurized triisobutylene, dicyclohexyl polysulfide, diphenyl polysulfide, dibenzyl polysulfide, dinonyl polysulfide, and mixtures of di-tert-butyl polysulfide such as mixtures of di-tert-butyl trisulfide, di-tert-butyl tetrasulfide and di-tert-butyl pentasulfide among others. Combinations of such categories of sulfur-containing antiwear and/or extreme pressure agents can also be used, such as a combination of sulfurized isobutylene and di-tert-butyl trisulfide, a combination of sulfurized isobutylene and dinonyl trisulfide, a combination of sulfurized tall oil and dibenzyl polysulfide.

In the context of this disclosure a component which contains both phosphorus and sulfur in its chemical structure is deemed a phosphorus-containing antiwear and/or extreme pressure agent rather than a sulfur-containing antiwear and/or extreme pressure agent.

Use can be made of a wide variety of phosphorus-containing oil-soluble antiwear and/or extreme pressure additives such as the oil-soluble organic phosphates, organic phosphites, organic phosphonates, organic phosphonites, etc., and their sulfur analogs. Also useful as the phosphorus-containing antiwear and/or extreme pressure additives that may be used in shock absorber fluids include those compounds that contain both phosphorus and nitrogen. Phosphorus-containing oil soluble antiwear and/or extreme pressure additives useful in shock absorber fluids include those compounds taught in U.S. Pat. Nos. 5,464,549; 5,500,140; and 5,573,696.

One such type of phosphorus- and nitrogen-containing antiwear and/or extreme pressure additives which can be used in shock absorber fluids are the phosphorus- and nitrogen-containing compositions of the type described in G.B. 1,009,913, G.B. 1,009,914; U.S. Pat. No. 3,197,405 and/or U.S. Pat. No. 3,197,496. In general, these compositions are formed by forming an acidic intermediate by the reaction of a hydroxy-substituted triester of a phosphorothioic acid with an inorganic phosphorus acid, phosphorus oxide or phosphorus halide, and neutralizing a substantial portion of said acidic intermediate with an amine or hydroxy-substituted amine. Other types of phosphorus- and nitrogen-containing antiwear and/or extreme pressure additive that may be used in shock absorber fluids include the amine salts of hydroxy-substituted phosphetanes or the amine salts of hydroxy-substituted thiophosphetanes and the amine salts of partial esters of phosphoric and thiophosphoric acids.

Antifoam Agents

Antifoam agents work by destabilizing the liquid film that surrounds entrained air bubbles. To be effective they must spread effectively at the air/liquid interface. According to theory, the antifoam agent will spread if the value of the spreading coefficient, S, is positive. S is defined by the following equation: S=P1−P2−P12, wherein Pi is the surface tension of the foamy liquid, P2 is the surface tension of the antifoam agent, and P1, 2 is the interfacial tension between them. Surface tension and interfacial tensions are measured using a ring type tensitometer by ASTM D 1331-89 (Reapproved 2001), "Surface and Interfacial Tension of Solutions of Surface-Active Agents". With respect to the current inventions p1 is the surface of the shock absorber fluid prior to the addition of antifoam agent.

Examples of antifoam agents are antifoam agents that when blended into the shock absorber fluid will exhibit spreading coefficients of at least 2 mN/m at both 24 degrees C. and 93.5 degrees C. Various types of antifoam agents are taught in U.S. Pat. No. 6,090,758. When used, the antifoam agents should not significantly increase the air release time of the shock absorber fluid. Examples of suitable antifoam agents are high molecular weight polydimethyl siloxane, a type of silicone antifoam agent, acrylate antifoam agents (as they are less likely to adversely effect air release properties compared to lower molecular weight silicone antifoam agents), polydimethylsiloxanes and polyethylene glycol ethers and esters.

Colorants or Dyes

Colorants or dyes are used to impart color or to fluoresce under particular types of light. Fluorescent dyes facilitate leak detection. Colored oils help distinguish between different lubricant products. Examples of these colorants or dyes are anthraquinones, azo compounds, triphenyl-methane, perylene dye, naphthalimide dye, and mixtures thereof. Particular types of fluorescent dyes are taught in U.S. Pat. No. 6,165,384.

Diluent Oil

Diluent oil is often used in the different types of additive packages to effectively suspend or dissolve the additives in a liquid medium. In general, the maximum amount of diluent oil in all of the additive packages used to make the shock absorber fluid should be within 0 to 40 volume %. In one embodiment the diluent oil is an extra light hydrocarbon liquid derived from highly paraffinic wax, described in US20060201852A, wherein the diluent oil has a viscosity of between about 1.0 and 3.5 $mm^2/s$ at 100° C. and a Noack volatility of less than 50 weight %, and also having greater than 3 weight % molecules with cycloparaffinic functionality and less than 0.30 weight percent aromatics.

Other base oils that may be used in the shock absorber fluids are conventional Group II base oils, conventional Group III base oils, GTL base oils, isomerized petroleum wax, polyalphaolefins, polyinternalolefins, oligomerized olefins from Fischer-Tropsch derived feed, esters, diesters, polyol esters, phosphate esters, alkylated aromatics, alkylated cycloparaffins, and mixtures thereof. Examples of suitable esters that have been shown to have particularly good air release properties are a) those comprising mixtures of open-chain and cyclic molecules of the sugar alcohols D-sorbitol and D-mannitol which have been esterified with at least one carboxylic acid as described in US Patent Publication US20040242919A1, and b) carbohydrate polycarboxylate esters as described in US Patent Publication US20050032653A1.

We have invented a method to use a shock absorber fluid, comprising selecting a shock absorber fluid having an auto ignition temperature greater than 329° C. (625° F.) and a viscosity index greater than 28×Ln(Kinematic Viscosity at 100° C.)+80, wherein the shock absorber fluid comprises a base oil made from a waxy feed, providing the shock absorber fluid to a mechanical system, and transferring heat in the mechanical system from a heat source to a heat sink.

Specific Analytical Test Methods:

Wt % boiling points are determined by ASTM D6352-04.

Wt % Naphthenic Carbon by n-d-M:

ASTM D 3238-915(Reapproved 2005) is used to determine wt % naphthenic carbon by n-d-M, % $C_N$.

Wt % Normal Paraffins in Wax-Containing Samples:

Quantitative analysis of normal paraffins in wax-containing samples is determined by gas chromatography (GOC) The GC (Agilent 6890 or 5890 with capillary split/splitless inlet and flame ionization detector) is equipped with a flame ionization detector, which is highly sensitive to hydrocarbons. The method utilizes a methyl silicone capillary column, routinely used to separate hydrocarbon mixtures by boiling point. The column is fused silica, 100% methyl silicone, 30 meters length, 0.25 mm ID, 0.1 micron film thickness supplied by Agilent. Helium is the carrier gas (2 ml/min) and hydrogen and air are used as the fuel to the flame.

The waxy feed is melted to obtain a 0.1 g homogeneous sample. The sample is immediately dissolved in carbon disulfide to give a 2 wt % solution. If necessary, the solution is heated until visually clear and free of solids, and then injected into the GC. The methyl silicone column is heated using the following temperature program:

Initial temp: 150° C. (If C7 to C15 hydrocarbons are present, the initial temperature is 50° C.)

Ramp: 6° C. per minute

Final Temp: 400° C.

Final hold: 5 minutes or until peaks no longer elute

The column then effectively separates, in the order of rising carbon number, the normal paraffins from the non-normal paraffins. A known reference standard is analyzed in the same manner to establish elution times of the specific normal-paraffin peaks. The standard is ASTM D2887 n-paraffin standard, purchased from a vendor (Agilent or Supelco), spiked with 5 wt % Polywax 500 polyethylene (purchased front Petrolite Corporation in Oklahoma). The standard is melted prior to injection. Historical data collected from the analysis of the reference standard also guarantees the resolving efficiency of the capillary column.

If present in the sample, normal paraffin peaks are well separated and; easily identifiable from other hydrocarbon types present in the sample. Those peaks eluting outside the retention time of the normal paraffins are called non-normal paraffins. The total sample is integrated using baseline hold from start to end of run. N-paraffins are skimmed from the total area and are integrated from valley to valley. All peaks detected are normalize to 100%. EZChrom is used for the peak identification and calculation of results.

Wt % Olefins:

The Wt % Olefins in the base oil is determined by proton-NMR by the following steps, A-D:

A. Prepare a solution of 5-10% of the test hydrocarbon in deuterochloroform.

B. Acquire a normal proton spectrum of at least 12 ppm spectral width and accurately reference, the chemical shift (ppm) axis. The instrument must have sufficient gain range to acquire a signal without overloading the receiver/ADC. When a 30 degree pulse is applied, the instrument must have a minimum signal digitization dynamic range of 65,000. Preferably the dynamic range will be 260,000 or more.

C. Measure the integral intensities between:

6.0-4.5 ppm (olefin)

2.2-1.9 ppm (allylic)

1.9-0.5 ppm (saturate)

D. Using the molecular weight of the test substance determined by ASTM D 2503, calculate.

1. The average molecular formula of the saturated hydrocarbons
2. The average molecular formula of the olefins
3. The total integral intensity (=sum of all integral intensities)
4. The integral intensity per sample hydrogen (=total integral/number of hydrogens in formula)
5. The number of olefin hydrogens (=olefin integral/integral per hydrogen)
6. The number of double bonds (=olefin hydrogen times hydrogens in olefin formula/2)
7. The wt % olefins by proton NMR=100 times the number of double bonds times the number of hydrogens in a typical olefin molecule divided by the number of hydrogens in a typical test substance molecule.

The wt % olefins by proton NMR calculation procedure, D, works best when the % olefins result is low, less than about 15 weight percent. The olefins must be "conventional" olefins, i.e. a distributed mixture of those olefin types having hydrogens attached to the double bond carbons such as alpha, vinylidene, cis, trans, and trisubstituted. These olefin types will have a detectable allylic to olefin integral ratio between 1 and about 2.5. When this ratio exceeds about 3, it indicates a higher percentage of tri or tetra substituted olefins are present and that different assumptions must be made to calculate the number of double bonds in the sample.

Aromatics Measurement by HPLC-UV;

The method used to measure low levels of molecules with at least one aromatic function in the lubricant base oils uses a Hewlett Packard 1050 Series Quaternary Gradient High Performance Liquid Chromatography (HPLC) system coupled with a HP 1050 Diode-Array UV-V is detector interfaced to an HP Chem-station. Identification of the individual aromatic classes in the highly saturated Base oils was made on the basis of their UV spectral pattern and their elution time. The amino column used for this analysis differentiates aromatic molecules largely on the basis of their ring-number (or more correctly, double-bond number). Thus, the single ring aromatic containing molecules elute first, followed by the polycyclic aromatics in order of increasing double bond number per molecule. For aromatics with similar double bond character, those with only alkyl substitution on the ring elute sooner than those with naphthenic substitution.

Unequivocal identification of the various base oil aromatic hydrocarbons from their UV absorbance spectra was accomplished recognizing that their peak electronic transitions were all red-shifted relative to the pure model compound analogs to a degree dependent on the amount of alkyl and naphthenic substitution on the ring system. These bathochromic shifts are well known to be caused by alkyl-group delocalization of the π-electrons in the aromatic ring. Since few unsubstituted aromatic compounds boil in the lubricant range, some degree of red-shift was expected and observed for all of the principle aromatic groups identified.

Quantitation of the eluting aromatic compounds was made by integrating chromatograms made from wavelengths optimized for each general class of compounds over the appropriate retention time window for that aromatic.

Retention time window limits for each aromatic class were determined by manually evaluating the individual absorbance spectra of eluting compounds at different times and assigning them to the appropriate aromatic class based on their qualitative similarity to model compound absorption spectra. With few exceptions, only five classes of aromatic compounds were observed in highly saturated API Group II and III lubricant base oils.

HPLC-UV Calibration:

HPLC-UV is used for identifying these classes of aromatic compounds even at very low levels. Multi-ring aromatics typically absorb 10 to 200 times more strongly than single-ring aromatics. Alkyl-substitution also affected absorption by about 20%. Therefore, it is important to use HPLC to separate and identify the various species of aromatics and know how efficiently they absorb.

Five classes of aromatic compounds were identified. With the exception of a small overlap between the most highly retained alkyl-1-ring aromatic naphthenes and the least highly retained alkyl naphthalenes, all of the aromatic compound classes were baseline resolved. Integration limits for the co-eluting 1-ring and 2-ring aromatics at 272 nm were made by the perpendicular drop method. Wavelength dependent response factors for each general aromatic class were first determined by constructing Beer's Law plots from pure model compound mixtures based on the nearest spectral peak absorbances to the substituted aromatic analogs.

For example, alkyl-cyclohexylbenzene molecules in base oils exhibit a distinct peak absorbance at 272 nm that corresponds to the same (forbidden) transition that unsubstituted tetralin model compounds do at 268 nm. The concentration of alkyl-1-ring aromatic naphthenes in base oil samples was calculated by assuming that its molar absorptivity response factor at 272 nm was approximately equal to tetralin's molar absorptivity at 268 nm, calculated from Beers law plots. Weight percent concentrations of aromatics were calculated by assuming that the average molecular weight for each aromatic class was approximately equal to the average molecular weight for the whole base oil sample.

This calibration method was further improved by isolating the 1-ring aromatics directly from the lubricant base oils via exhaustive HPLC chromatography. Calibrating directly with these aromatics eliminated the assumptions and uncertainties associated with the model compounds. As expected, the isolated aromatic sample had a lower response factor than the model compound because it was more highly substituted.

More specifically, to accurately calibrate the HPLC-UV method, the substituted benzene aromatics were separated from the bulk of the lubricant base oil using a Waters semi-preparative HPLC unit. 10 grams of sample was diluted 1:1 in n-hexane and injected onto an amino-bonded silica column, a 5 cm×22.4 mm ID guard, followed by two 25 cm×22.4 mm ID columns of 8-12 micron amino-bonded silica particles, manufactured by Rainin Instruments, Emeryville, Calif., with n-hexane as the mobile phase at a flow rate of 18 mls/min. Column eluent was fractionated based on the detector response from a dual wavelength UV detector set at 265 nm and 295 nm. Saturate fractions were collected until the 265 nm n absorbance showed a change of 0.01 absorbance units, which signaled the onset of single ring aromatic elution. A single ring aromatic fraction was collected until the absorbance ratio between 265 nm and 295 nm decreased to 2.0, indicating the onset of two ring aromatic elution. Purification and separation of the single ring aromatic fraction was made by re-chromatographing the monoaromatic fraction away from the "tailing" saturates fraction which resulted from overloading the HPLC column.

This purified aromatic "standard" showed that alkyl substitution decreased the molar absorptivity response factor by about 20% relative to unsubstituted tetralin.

Confirmation of Aromatics by NMR:

The weight percent of all molecules with at least one aromatic function in the purified mono-aromatic standard was confirmed via long-duration carbon 13 NMR analysis. NMR was easier to calibrate than HPLC UV because it simply measured aromatic carbon so the response did not depend on the class of aromatics being analyzed. The NMR results were translated from % aromatic carbon to % aromatic molecules (to be consistent with HPLC-UV and D 2007) by knowing that 95-99% of the aromatics in highly saturated lubricant base oils were single-ring aromatics.

High power, long duration, and good baseline analysis were needed to accurately measure aromatics down to 0.2% aromatic molecules.

More specifically, to accurately measure low levels of all molecules with at least one aromatic function by NMR, the standard D 5292-99 method was modified to give a minimum carbon sensitivity of 500:1 (by ASTM standard practice E 386). A15-hour duration run on a 400-500 MHz NMR with a 10-12 mm Nalorac probe was used. Acorn PC integration software was used to define the shape of the baseline and consistently integrate. The carrier frequency was changed once during the run to avoid artifacts from imaging the aliphatic peak into the aromatic region. By taking spectra on either side of the carrier spectra, the resolution was improved significantly.

Molecular Composition by FIMS:

The lubricant base oils were characterized by Field Ionization Mass Spectrosopy (FIMS) into alkanes and molecules with different numbers of unsaturations. The distribution of the molecules in the oil fractions was determined by FIMS. The samples were introduced via solid probe, preferably by placing a small amount (about 0.1 mg.) of the base oil to be tested in a glass capillary tube. The capillary tube was placed at the tip of a solids probe for a mass spectrometer, and the probe was heated from about 40 to 50° C. up to 500 or 600° C. at a rate between 50° C. and 100° C. per minute in a mass spectrometer operating at about $10^{-6}$ torr. The mass spectrometer was scanned from m/z 40 to m/z 1000 at a rate of 5 seconds per decade.

The mass spectrometer used was a Micromass Time-of-Flight. Response factors for all compound types were assumed to be 1.0 such that weight percent was determined from area percent. The acquired mass spectra were summed to generate one "averaged" spectrum.

The lubricant base oils were characterized by FIMS into alkanes and molecules with different numbers of unsaturations. The molecules with different numbers of unsaturations may be comprised of cycloparaffins, olefins, and aromatics. If aromatics were present in significant amounts in the lubricant base oil they would be identified in the FIMS analysis as 4-unsaturations. When olefins were present in significant amounts in the lubricant base oil they would be identified in the FIMS analysis as 1-unsaturations. The total Of the 1-unsaturations, 2-unsaturations, 3-unsaturations, 4-unsaturations, 5-unsaturations, and 6-unsaturations from the FIMS analysis, minus the wt % olefins by proton NMR, and minus the wt % aromatics by HPLC-UV is the total weight percent of molecules with cycloparaffinic functionality in the lubricant base oils. Note that if the aromatics contents was not measured, it was assumed to be less than 0.1 wt % and not included in the calculation for total weight percent of molecules with cycloparaffinic functionality.

Molecules with cycloparaffinic functionality mean any molecule that is or contains as one or more substituents, a monocyclic or a fused multicyclic saturated hydrocarbon group. The cycloparaffinic group may be optionally substituted with one or more substituents. Representative examples include, but are not limited to, cyclopropyl, cyclobutyl, cyclopentyl, cyclohexyl, cycloheptyl, decahydronaphthalene, octahydropentalene, (pentadiecan-6-yl)cyclohexane, 3,7,10-tricyclohexylpentadecarne, decahydro-1-(pentadecan-6-yl) naphthalene, and the like.

Molecules with monocycloparaffinic functionality mean any molecule that is a monocyclic saturated hydrocarbon group of three to seven ring carbons or any molecule that is substituted with a single monocyclic saturated hydrocarbon group of three to seven ring carbons. The cycloparaffinic group may be optionally substituted with one or more substituents. Representative examples include, but are not limited to, cyclopropyl, cyclobutyl, cyclopentyl, cyclohexyl, cycloheptyl, (pentadecan-6-yl)cyclohexane, and the like.

Molecules with multicycloparaffinic functionality mean any molecule that is a fused multicyclic saturated hydrocarbon ring group of two or more fused rings, any molecule that is substituted with one or more fused multicyclic, saturated hydrocarbon ring groups of two or more fused rings, or any molecule that is substituted with more than one monocyclic saturated hydrocarbon group of three to seven ring carbons. The fused multicyclic saturated hydrocarbon ring group in one embodiment is of two fused rings. The cycloparaffinic group may be optionally substituted with one or more substituents. Representative examples include, but are not limited to, decahydronaphthalene, octahydropentalene, 3,7,10-tricyclohexylpentadecane, decahydro-1-(pentadecan-6-yl) naphthalene, and the like.

Hydraulic Shock Absorber:

Improved hydraulic shock absorbers are made and operated with the shock absorbers having improved performance disclosed herein. The shock absorbers are mounted on equipment, such as passenger cars, sport utility vehicles, or trucks. The shock absorbers with improved performance are also useful on racing cars, where demands on the shock absorber may be extreme.

The following Examples are given as non limiting illustrations of aspects of the present invention.

EXAMPLES

Example 1

Two base oils were prepared by hydroisomerization dewaxing a Co-based Fischer-Tropsch wax and a Fe-based Fischer-Tropsch wax over a Pt/SAPO-11 catalyst at 1000 psi, 0.5-1.5 LHSV, and between 660-690° C. They were subsequently hydrotreated to reduce the level of aromatics and olefins, then vacuum distilled into fractions.

The FIMS analysis was conducted on a Micromass Time-of-Flight spectrophotometer. The emitter on the Micromass Time-of-Flight was a Carbotec 5 um emitter designed for FI operation. A constant flow of pentafluorochlorobenzene, used as lock mass, was delivered into the mass spectrometer via a thin capillary tube. The probe was heated from about 50° C. up to 600° C. at a rate of 100° C. per minutes Test data on the two Fischer-Tropsch derived lubricant base oils are shown in Table II, below

TABLE II

| Sample Properties | FT-XXL-1 | FT-XL-1 |
|---|---|---|
| Made from: | Co-based Fischer-Tropsch wax | Fe-based Fischer-Tropsch wax |

TABLE II-continued

| Sample Properties | FT-XXL-1 | FT-XL-1 |
|---|---|---|
| Viscosity at 100° C., $mm^2/s$ | 2.18 | 2.981 |
| Viscosity Index | 123 | 127 |
| Pour Point, ° C. | −37 | −27 |
| Wt % Aromatics | <0.1 | 0.0128 |
| Wt % Olefins | <1.0 | 0.9 |
| FIMS, Wt % | | |
| Alkanes | 93.2 | 89.2 |
| 1-Unsaturations | 6.8 | 10.8 |
| 2-to 6-Unsaturations | 0.0 | 0.0 |
| Total | 100.0 | 100.0 |
| Total Molecules with Cycloparaffinic Functionality | >5.8 | 9.9 |
| Ratio of Monocycloparaffins to Multicycloparaffins | >100 | >100 |
| X in the equation: VI = 28 × Ln (VIS100) + X | 101.2 | 96 |
| TGA Noack Volatility, wt % | 67.4 | 48.0 |
| Noack Volatility Factor | 72.8 | 40.76 |
| % Naphthenic Carbon by n-d-M | 2.87 | <5 |
| Average Molecular Weight | 324 | 357 |

Example 2

Three different blends of shock absorber fluid were prepared using the FT-XXL-1 and FT-XL-1 base oils of example 1. The formulations and properties of these blends are summarized in Table III.

TABLE III

| Component, Wt % | SAFA | SAFB | SAFC |
|---|---|---|---|
| Base Oils | Blend of FT-XXL-1 and FT-XL-1 | FT-XL-1 | FT-XL-1 |
| Wt % Base Oil | 96.15 | 96.15 | 97.05 |
| Wt % Viscosity Index Improver | 0.9 | 0.9 | 0.0 |
| Wt % DI Additive Package | 2.55 | 2.55 | 2.55 |
| Wt % Pour Point Depressant | 0.4 | 0.4 | 0.4 |
| Wt % VII and PPD | 1.1 | 1.1 | 0.4 |
| Total | 100.00 | 100.00 | 100.00 |

Note that SAFA, SAFB, and SAFC all have less than 4 wt % combined viscosity index improver and pour point depressant with SAFC only having 0.4 wt %.

The properties of these three different shock absorber fluids are shown in Table IV.

TABLE IV

| Properties | Spec. | SAFA | SAFB | SAFC |
|---|---|---|---|---|
| Viscosity at 100° C., $mm^2/s$ | | 2.56 | 3.23 | 3.11 |
| Viscosity Index | | 153 | 157 | 135 |
| Aniline Point. ° C. | >88 | 110.2 | 111.3 | 112.1 |
| Brookfield Vis @ −18° C., MPa · s | <390 | 100 | 190 | 160 |
| Brookfield Vis @ −30° C., MPa · s | <1200 | 270 | 500 | 510 |

All three of these oils showed exceptional viscometric properties, and high aniline points. Even without any viscosity index improver, SAFC had a viscosity index greater than or equal to 129.

Example 3

Two Fischer-Tropsch derived base offs were made from hydrotreated Co-based Fischer-Tropsch wax. The properties of these two base oils are summarized in Table V.

TABLE V

| Sample Properties | FT-XXL-2 | FT-XL-2 |
|---|---|---|
| Viscosity at 100° C., $mm^2/s$ | 2.362 | 3.081 |
| Viscosity Index | 123 | 124 |
| Pour Point, ° C. | −39 | −43 |
| Wt % Aromatics | 0.0205 | 0.0043 |
| Wt % Olefins | <0.1 | <0.1 |
| FIMS, Wt % | | |
| Alkanes | 75.3 | 72.5 |
| 1-Unsaturations | 20.7 | 23.1 |
| 2-to 6-Unsaturations | 4.0 | 4.4 |
| Total | 100.0 | 100.0 |
| Total Molecules with Cycloparaffinic Functionality | 24.7 | 27.5 |
| Ratio of Monocycloparaffins to Multicycloparaffins | 5.2 | 5.3 |
| X in the equation: VI = 28 × Ln (VIS100) + X | 98.9 | 92.5 |
| TGA Noack Volatility, wt % | 63.1 | 31.1 |
| Noack Volatility Factor | 65.5 | 36.76 |

TABLE V-continued

| Sample Properties | FT-XXL-2 | FT-XL-2 |
|---|---|---|
| % Naphthenic Carbon by n-d-M | 3.86 | 4.83 |
| Average Molecular Weight | 329 | 381 |

Example 4

Three shock absorber fluids % were blended using the FT-XXL-2 and FT-XL-2 base oils described above. A, comparison commercial formulation of shock absorber fluid made using petroleum derived naphthenic and paraffinic base oils was prepared (COMP SAFD). A second comparison blend of shock absorber fluid was blended using a petroleum derived paraffinic base oil (deeply dewaxed mineral oil) and similar additives as those used in the other shock absorber fluids (COMP SAFE). Viscosity index improver was added as needed to obtain kinematic viscosities at 100° C. of about 2.4 $mm^2/S$ or greater. The formulations and properties of the different shock absorber fluids are summarized in Table VI, below.

TABLE VI

| Composition/ Properties | Test Method | COMP SAFD | COMP SAFE | SAFF | SAFG | SAFH |
|---|---|---|---|---|---|---|
| Wt % Naphthenic Oil | | 61.00 | 0 | 0 | 0 | 0 |
| Wt % Paraffinic Oil | | 36.15 | 98.04 | 0 | 0 | 0 |
| Wt % FT-XXL-2 | | 0 | 0 | 98.935 | 96.635 | 0 |
| Wt % FT-XL-2 | | 0 | 0 | 0 | 0 | 98.935 |
| Wt % DI Additive Pkg. | | 2.05 | 0.75 | 0.75 | 0.75 | 0.75 |
| Wt % Friction Modifier | | 0.5 | 0.3 | 0.3 | 0.3 | 0.3 |
| Wt % Viscosity Index Improver | | 0.3 | 0.9 | 0.0 | 2.3 | 0.0 |
| Wt % Pour Point Depressant | | 0.0 | 0.0 | 0.0 | 0.0 | 0.0 |
| Wt % VII and PPD | | 0.3 | 0.9 | 0.0 | 2.3 | 0.0 |
| Wt % Antifoam Agent | | 0 | 0.01 | 0.015 | 0.015 | 0.015 |
| Total Wt % | | 100.0 | 100.0 | 100.0 | 100.0 | 100.0 |
| Kinematic Viscosity at 100° C., $mm^2/s$ | ASTM D 445 | 2.73 | 3.26 | 2.44 | 3.35 | 3.16 |
| Viscosity Index | ASTM D 2270 | 97 | 133 | 130 | 215 | 129 |
| Pour Point, ° C. | ASTM D 5950 | −54 | −54 | −45 | −60 | −51 |
| Brookfield Vis @-18° C., MPa · S | ASTM D 2983 | 252 | 240 | 102 | 126 | 200 |
| Brookfield Vis @-30° C., MPa · s | ASTM D 2983 | 930 | 860 | 240 | 270 | 510 |
| Aniline Point, ° C. | ASTM D611 | 72.8 | 91.5 | 109.6 | 109.6 | 114.9 |
| Flash Point, ° C. | ASTM D 92 | 144 | 192 | 196 | 192 | 214 |
| Evap. Loss (1 hr/ 200° C.), wt % | CEC-L43-A-93 modified | 39.5 | 11.1 | 11.0 | 10.6 | 3.5 |
| Copper Corrosion | ASTM D 130 | 1a | 1b | 1a | 1b | 1b |
| 4 Ball Wear, mm, 40 kg | ASTM D 4172 | Shuddering | 0.48 | 0.43 | 0.40 | 0.45 |
| Acid Number, mgKOH/g | ASTM D 664 | 1.9 | 0.43 | 0.67 | 0.65 | 0.70 |
| Foam Sequence I, ml | ASTM D 892 | 40/0 | 10/0 | 0/0 | 0/0 | 0/0 |
| Sequence II, ml | | 20/0 | 40/0 | 30/0 | 50/0 | 10/0 |
| Sequence III, ml | | 50/0 | 0/0 | 0/0 | 0/0 | 0/0 |
| Air Release | DIN 51381 | | | | | |

TABLE VI-continued

| Composition/ Properties | Test Method | COMP SAFD | COMP SAFE | SAFF | SAFG | SAFH |
|---|---|---|---|---|---|---|
| Vol % after 30 s | | 2.10 | 2.31 | 0.25 | 0.20 | 0.12 |
| Vol % after 1 min | | 0.88 | 1.44 | 0.05 | 0.07 | 0.05 |
| Vol % after 1 min 30 s | | 0.47 | 0.82 | 0.02 | 0.02 | 0.02 |
| Vol % after 2 min | | 0.29 | 0.46 | 0.01 | 0.00 | 0.01 |
| Oxidation Stability, 160° C., 96 hours | CEC L-48-A-00 method B | | | | | |
| ΔKV100, % | | 3 | −4 | 0 | −8 | 0 |
| ΔAcid Number, mgKOH/g | modified (VW conditions) | 1.4 | 0.7 | 0 | 0.1 | −0.1 |
| Peak Area Increase | | 104 | 51 | 3 | 4 | 3 |
| Shear Stability, KRL 20 hrs | CEC L-45-A-99 | | | | | |
| KV 100 after shear, $mm^2/s$ | | 2.41 | 2.88 | 2.42 | 2.81 | 3.16 |
| % Shear Loss | | 11.1 | 0.7 | 0.8 | 16.1 | 0.0 |
| After Ageing, 140° C., 24 hrs | | | 50/0 | 0/0 | 0/0 | 0/0 |
| Foam Sequence I, ml | D 892 | 70/0 | 60/0 | 30/0 | 40/0 | 10/0 |
| Foam Sequence II, ml | D 892 | 40/0 | | | | |
| Air Release | DIN 51381 | | | | | |
| Vol % after 40 s | | 1.99 | 2.24 | 0.21 | 0.18 | 0.22 |
| Vol % after 1 min | | 0.79 | 1.26 | 0.11 | 0.03 | 0.02 |
| Vol % after 1 min 30 s | | 0.41 | 0.69 | 0.09 | 0.00 | 0.00 |
| Vol % after 2 min | | 0.28 | 0.37 | 0.08 | 0.00 | 0.00 |

Again, all three of the shock absorber fluids of this example (SAFF, SAFG and SAFH) showed exceptional viscometrics, highly desired high aniline points excellent oxidation stability, improved 4-ball wear, good to excellent shear stability, low evaporation loss, high flash points, exceptionally fast air release, high flash points, and very low foaming. They required significantly lower amounts of additive package and friction modifier than the commercial shock absorber fluid, COMP SAFD. All three of the shock absorber fluids of this example had excellent low air release results considering that they only included base oils with average molecular weights less than 475 and with viscosity indexes less than 140. Sample SAFG met the specifications for Kayaba 0304-050-0002 and SAFH met the specifications for both Kayaba 0304-050-0002 and VW TL 731 class A shock absorber fluids. Even though the shock absorber fluids in this example had very high aniline points, there was no evidence of any additive insolubility or elastomer incompatibility.

Examples SAFF and SAFH are examples of functional fluid having a flash point greater than 195° C. and a kinematic viscosity at 100° C. less than 5 $mm^2/s$, comprising greater than 95 wt % of a base oil having consecutive numbers of carbon atoms and between 2 wt % and less than 5 wt % naphthenic carbon; and wherein the base oil is an XLN grade, an XXLN grade, or a blend of XLN grade and XXLN grade.

Example 5

The same blends described in Example 4 were tested in duplicate in a shock absorber endurance test. The shock absorber endurance test was performed in a Servotest test rig. The Servotest rig was equipped for testing up to 6 shock absorbers at a time and for testing a variety of shock absorbers having dampers for passenger cars Lip to dampers for trains. The type of shock absorbers used in the shock absorber endurance test were KONI 80-1350 twin-tube, serviceable, adjustable shock absorbers for use in passenger cars. The shock absorber piston valve determined the damping in the rebound phase, and the shook absorber bottom valve determined the damping in the compression or bound phase. The dampers were submitted to an oscillating movement (sinusoidal) with a frequency of 1.0 Hz and a stroke of 70 mm. Stroke is defined as twice the amplitude of the oscillating movement of the dampers. During the test, the dampers were also submitted to a constant side load of 110 N by means of a compressed air piston to enable consistent wearing. The temperatures of the individual dampers were monitored by means of temperature sensors. The temperatures were monitored on a continuous basis and were automatically adjusted to maintain temperatures between 95 and 105° C. by means of pressurized air flows. The dampers were adjusted to a damping force of 1150 N at a velocity of 0.22 m/s in rebound phase before testing to ensure consistency. The damping curve was measured before and after the endurance test, and the peak area increase was calculated. At the end of the test the quality of the oil was evaluated and the hardware of the damper was checked for wear. The duration of the test was 280 hours and 1,008,000 cycles.

The averaged results of the duplicate shock absorber endurance tests are summarized in Table VII.

TABLE VII

| Properties | COMP SAFD | COMP SAFE | SAFF | SAFG | SAFH |
|---|---|---|---|---|---|
| Oil Loss, % | 21 | 10 | 4 | 6 | 1 |
| Piston Wear, g | <0.010 | 0.152 | 0.023 | <0.010 | 0.045 |

TABLE VII-continued

| Properties | COMP SAFD | COMP SAFE | SAFF | SAFG | SAFH |
|---|---|---|---|---|---|
| Liner Wear, g | 0.041 | 0.055 | 0.056 | 0.051 | 0.046 |
| Bottom Valve Wear, g | 0.005 | 0.035 | 0.045 | 0.047 | 0.032 |
| ΔKV100, % | −1 | −8.5 | 1 | −17 | 0 |
| Iron, ppm | 374 | 330 | 221 | 254 | 220 |
| Peak Area Increase | 8.5 | 1.5 | <1 | 2 | <1 |

The shock absorber fluids in this example provided excellent shock absorber wear protection. They gave much lower iron levels and % oil loss in the shock absorber endurance test than the comparison samples. They also showed very low peak area increases. SAFF and SAFG, which both contained no viscosity index improver, showed especially good shear stability (low ΔKV100, %), low oil loss, and no measurable peak area increase.

Patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments disclosed above will readily occur to those skilled in the art. Accordingly, the invention is to be construed as including all structure and methods that fall within the scope of the appended claims.

What is claimed is:

1. A shock absorber fluid, comprising:

a. a base oil, that is not an oil based on PAO, having consecutive numbers of carbon atoms, a kinematic viscosity at 100° C. between 1.5 and 3.5 $mm^2/s$, a pour point less than −35° C., from greater than 5.8 wt % up to 27.5 wt % total molecules with cycloparaffinic functionality, and less than 10 wt % naphthenic carbon;

b. additives; and c. less than 3.0 wt % pour point depressant, based on the total shock absorber fluid;

wherein the shock absorber fluid has an air release after 1 minute by DIN 51381 of less than 0.8 vol %; and wherein the shock absorber fluid is made without any viscosity index improver and has a viscosity index greater than or equal to 129.

2. The shock absorber fluid of claim 1, wherein the base oil has a viscosity index greater than 121.

3. The shock absorber fluid of claim 1, wherein the base oil has a viscosity index such that X in the equation VI=28×Ln (Kinematic Viscosity at 100° C.)+X, is greater than 90.

4. The shock absorber fluid of claim 1, additionally having an aniline point greater than 88° C.

5. The shock absorber fluid of claim 4, wherein the aniline point is greater than or equal to 95° C.

6. The shock absorber fluid of claim 1, wherein the base oil has less than 5 wt % naphthenic carbon.

7. The shock absorber fluid of claim 1, comprising from zero to 2.3 wt % based on the total shock absorber fluid of pour point depressant.

8. The shock absorber fluid of claim 1, comprising less than 2.0 wt % based on the total shock absorber fluid of pour point depressant.

9. The shock absorber fluid of claim 1, additionally comprising a pour point reducing blend component.

10. The shock absorber fluid of claim 1, wherein the air release after 1 minute by DIN 51381 is less than or equal to 0.5 vol %.

11. A functional fluid having a flash point greater than 195° C., a viscosity index greater than or equal to 129, and a kinematic viscosity at 100° C. less than 5 $mm^2/s$, comprising: additives; no viscosity index improver, and greater than 95 wt % based on the total functional fluid composition of a base oil, that is not an oil based on PAO, wherein the base oil has: consecutive numbers of carbon atoms, a pour point less than −35° C., greater than 5.8 wt % total molecules with cycloparaffinic functionality, and between 2 wt % and less than 5 wt % naphthenic carbon; and wherein the base oil is an XLN grade having a kinematic viscosity at 100° C. between about 2.3 and about 3.5 $mm^2/s$, an XXLN grade having a kinematic viscosity at 100° C. between about 1.8 and 2.3 $mm^2/s$, or a blend of the XLN grade and the XXLN grade.

12. The functional fluid of claim 11, wherein the base oil is Fischer-Tropsch derived.

13. The functional fluid of claim 11, wherein the flash point is greater than 200° C.

14. The functional fluid of claim 11, wherein the kinematic viscosity at 100° C. is between 2.0 and 4.0 $mm^2/s$.

15. The functional fluid of claim 11, additionally comprising 0.4 wt % or less, based on the total functional fluid composition, of pour point depressant.

16. The functional fluid of claim 11, additionally comprising a pour point reducing blend component.

17. A functional fluid, comprising a base oil having: a base oil kinematic viscosity of at least 1.5 $mm^2/s$ and a viscosity index greater than an amount calculated by the equation: 22×Ln (Kinematic Viscosity at 100° C., in $mm^2/s$)+132; wherein the functional fluid has a kinematic viscosity at 100° C. between 2.5 and 5.0 $mm^2/s$, a Brookfield viscosity at −30° C. less than 1,000 mPa·s, an aniline point greater than or equal to 95° C., and an air release after 1 minute by DIN 51381 of less than 0.8 vol %.

18. The functional fluid of claim 17, additionally comprising a pour point reducing blend component.

19. A hydraulic shock absorber, comprising: a hydraulic fluid reservoir holding a shock absorber fluid, wherein the shock absorber fluid is the composition of claim 17.

20. A method of operating a shock absorber, comprising: placing in a hydraulic fluid reservoir in the shock absorber a shock absorber fluid, wherein the shock absorber fluid is the composition of claim 17 or claim 1.

21. The method of operating a shock absorber of claim 20, wherein the shock absorber is mounted on a passenger car, a sport utility vehicle, or a truck.

22. The method of operating a shock absorber of claim 21, wherein the passenger car is a racing car.

23. The shock absorber fluid of claim 1, wherein the shock absorber fluid has an air release after 1 minute by DIN 51381 of 0.07 vol % or less.

24. The shock absorber fluid of claim 1, comprising 0.4 wt % or less pour point depressant.

25. The shock absorber fluid of claim 1, wherein the shock absorber fluid has a flash point greater than 195° C.

26. The functional fluid of claim 17, additionally comprising less than 4.0 wt % combined viscosity index improver and pour point depressant, based on the total functional fluid.

27. The shock absorber fluid of claim 1, wherein the base oil has greater than 10 wt % up to 27.5 wt. % total molecules with cycloparaffinic functionality.

28. The shock absorber fluid of claim 1, wherein the base oil has greater than 20 wt % up to 27.5 wt. % total molecules with cycloparaffinic functionality.

* * * * *